US008980423B2

(12) United States Patent
Taniguchi et al.

(10) Patent No.: US 8,980,423 B2
(45) Date of Patent: Mar. 17, 2015

(54) CHARGING MEMBER, PROCESS FOR ITS PRODUCTION, PROCESS CARTRIDGE

(75) Inventors: Tomohito Taniguchi, Suntou-gun (JP); Takumi Furukawa, Susono (JP); Hidekazu Matsuda, Susono (JP); Yusuke Yagisawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

(21) Appl. No.: 12/723,148

(22) Filed: Mar. 12, 2010

(65) Prior Publication Data

US 2010/0166454 A1 Jul. 1, 2010

Related U.S. Application Data

(63) Continuation of application No. PCT/JP2009/067969, filed on Oct. 13, 2009.

(30) Foreign Application Priority Data

Oct. 27, 2008 (JP) ..... 2008-275702

(51) Int. Cl.
*G03G 5/04* (2006.01)
*G03G 15/02* (2006.01)

(52) U.S. Cl.
CPC ..... *G03G 15/0233* (2013.01)
USPC ..... 428/323

(58) Field of Classification Search
CPC .. C08F 265/00–265/04; C08F 257/00–257/02; G03G 5/04
USPC ..... 428/323
See application file for complete search history.

(56) References Cited

U.S. PATENT DOCUMENTS 5,739,077 A * 4/1998 Goto et al. ..... 503/200
6,400,919 B1 6/2002 Inoue et al.

(Continued)

FOREIGN PATENT DOCUMENTS

CN 101002146 A 7/2007
CN 101223484 A 7/2008

(Continued)

OTHER PUBLICATIONS

Epichlorohydrin Rubber product literature downoload on Feb. 8, 2012 from http://www.robinsonrubber.com/pdfs/EpichlohydronRubber.pdf.*

(Continued)

*Primary Examiner* — Elizabeth A Robinson
(74) *Attorney, Agent, or Firm* — Fitzpatrick, Cella, Harper & Scinto

(57) ABSTRACT

Concerned with a charging member in the conductive surface layer of which the conductive particles are so kept from agglomerating as to make charging performance not easily change even where the surface layer expands and contracts repeatedly in various environments. The charging member is a charging member having a conductive substrate and formed on the substrate a conductive elastic layer and a conductive surface layer. The elastic layer contains a polymer having a unit coming from ethylene oxide, and the surface layer contains a binder resin and graphitized particles. The binder resin contains a resin having in the molecule a urethane linkage or a siloxane linkage, or a urethane linkage and a siloxane linkage, and the graphitized particles have a graphite (002) plane lattice spacing of from 0.3362 nm or more to 0.3449 nm or less.

5 Claims, 2 Drawing Sheets

(56) References Cited

U.S. PATENT DOCUMENTS

| | | | | |
|---|---|---|---|---|
| 6,615,015 | B2 | 9/2003 | Nakazawa et al. | |
| 6,718,148 | B2 | 4/2004 | Kobayashi et al. | |
| 6,766,127 | B2 | 7/2004 | Tanaka et al. | |
| 6,775,494 | B2 | 8/2004 | Kusaba et al. | |
| 6,795,667 | B2 | 9/2004 | Nakazawa et al. | |
| 6,853,824 | B2 | 2/2005 | Kashiwabara et al. | |
| 6,856,776 | B2 | 2/2005 | Matsuda et al. | |
| 6,928,256 | B2 | 8/2005 | Matsuda et al. | |
| 6,962,746 | B2 | 11/2005 | Taniguchi et al. | |
| 7,054,579 | B2 | 5/2006 | Taniguchi et al. | |
| 7,664,434 | B2 | 2/2010 | Kuroda et al. | |
| 8,064,803 | B2 | 11/2011 | Karoda et al. | |
| 2003/0118372 | A1 * | 6/2003 | Kitano et al. | 399/176 |
| 2007/0036968 | A1 * | 2/2007 | Shimamura et al. | 428/323 |
| 2008/0292366 | A1 | 11/2008 | Akama et al. | |
| 2009/0297178 | A1 | 12/2009 | Kakuta et al. | |

FOREIGN PATENT DOCUMENTS

| | | | |
|---|---|---|---|
| JP | 09-305024 | | 11/1997 |
| JP | 2001-166563 | | 6/2001 |
| JP | 2003-107825 | | 4/2003 |
| JP | 2003-207994 | | 7/2003 |
| JP | 2003-316213 | | 11/2003 |
| JP | 2003-345095 | | 12/2003 |
| JP | 2004037672 | | 2/2004 |
| JP | 2004-157384 | | 6/2004 |
| JP | 2004-217450 | | 8/2004 |
| JP | 2004295095 | A * | 10/2004 |
| JP | 2005-010538 | | 1/2005 |
| JP | 2005-292418 | | 10/2005 |
| JP | 2007-183482 | A | 7/2007 |
| JP | 2007183482 | A * | 7/2007 |
| WO | 2006/001171 | | 1/2006 |
| WO | 2007/100070 | | 9/2007 |

OTHER PUBLICATIONS

International Preliminary Report on Patentability in PCT/JP2009/067969, dated Jun. 16, 2009.

"Properties and Optimum Combination of Carbon Black and Application Techniques" (May 26, 1997, published by Technical Information Institute Co., Ltd.), p. 8, Fig. 9, and partial translation thereof.

"Carbon Black Handbook, 3rd Edition" (Apr. 15, 1995, published by Carbon Black Association), and partial translation thereof. p. 56, Figs. 1, 4.

"Hitachi Powder Metallurgy Technical Report No. 3 (2004)," p. 2, right column, lines 2 to 6), and partial translation thereof.

Office Action in Korean Patent Application No. 10-2011-7011404, dated Aug. 27, 2012.

Extended Search Report in European Patent Application No. 09823485.9, dated Aug. 29, 2012.

Office Action in Korean Patent Application No. 10-2011-7011404, mailed Mar. 29, 2013.

Office Action in Chinese Patent Application No. 200980142667.2, mailed Jan. 31, 2013 (with partial English translation).

* cited by examiner

CHARGING MEMBER, PROCESS FOR ITS PRODUCTION, PROCESS CARTRIDGE

CROSS-REFERENCE TO RELATED APPLICATIONS

This application is a continuation of International Application No. PCT/JP2009/067969, filed Oct. 13, 2009, which claims the benefit of Japanese Patent Application No. 2008-275702, filed Oct. 27, 2008.

BACKGROUND OF THE INVENTION

1. Field of the Invention

This invention relates to a charging member, process for its production, a process cartridge, and an electrophotographic apparatus.

2. Description of the Related Art

Japanese Patent Laid-open Application No. 2004-157384 discloses a charging member which has a conductive elastic layer made up of a rubber having a unit coming from ethylene oxide, such as epichlorohydrin rubber, and provided on the conductive elastic layer a conductive cover layer as a surface layer.

SUMMARY OF THE INVENTION

The rubber constituting the conductive elastic layer has a high moisture absorption as having the unit coming from ethylene oxide. Hence, the conductive elastic layer expands and contracts repeatedly, depending on the surrounding humidity. With such expansion and contraction of the conductive elastic layer, the conductive cover layer on the conductive elastic layer also expands and contracts repeatedly. As this occurs, the present inventors have found that, where the conductive cover layer is one having been made conductive by dispersing conductive particles in a binder resin, a problem as stated below may come about. That is, the present inventors have found that, as the conductive cover layer expands and contracts repeatedly, the conductive particles in the conductive cover layer move and such conductive particles mutually come to agglomerate. Such agglomeration of the conductive particles makes the conductive cover layer non-uniform in its volume resistivity. Thus, the present inventors have come aware that this is a problem to be resolved in order to obtain a charging member having stabler performance.

Accordingly, the present invention is directed to provide a charging member in the conductive surface layer of which the conductive particles are so kept from agglomerating as to make charging performance not easily change even where the surface layer expands and contracts repeatedly in various environments, and a process for its production. The present invention is also directed to provide an electrophotographic apparatus and a process cartridge which both can form high-grade electrophotographic images stably even in various environments.

The present inventors have made studies variously on the above problem. As the result, they have discovered that a surface layer having been made conductive by dispersing graphitized particles having a specific crystalline state, in a binder resin having at least one linkage selected from the group consisting of a urethane linkage and a siloxane linkage can well keep the graphitized particles from moving or agglomerating in the conductive surface layer even where it has repeatedly expanded and contracted. The present invention is based on such a new finding made by the present inventors.

According to one aspect of the present invention, there is provided a charging member which comprises a conductive substrate and formed thereon a conductive elastic layer and a conductive surface layer, wherein said elastic layer comprises a polymer having a unit derived from ethylene oxide, and said surface layer comprises a binder resin and a graphitized particle, wherein said binder resin comprises a resin having in the molecule a urethane linkage or a siloxane linkage, or a urethane linkage and a siloxane linkage, and wherein said graphitized particle has a graphite (002) plane lattice spacing of from 0.3362 nm or more to 0.3449 nm or less.

According to another aspect of the present invention, there is provided a process for producing the aforementioned charging member, comprising the steps of: coating the surface of an elastic layer with a surface layer forming coating solution which comprises a raw material for a resin having in the molecule a urethane linkage or a siloxane linkage, or a urethane linkage and a siloxane linkage, and a graphitized particle having a graphite (002) plane lattice spacing of from 0.3362 nm or more to 0.3449 nm or less, and allowing the raw material for the resin to react to form the surface layer.

According to the present invention, a charging member can be obtained which exhibits stable and good charging performance even in various environments. According to the present invention, an electrophotographic apparatus and a process cartridge can also be obtained which both can form high-grade electrophotographic images stably even in various environments.

Further features of the present invention will become apparent from the following description of exemplary embodiments with reference to the attached drawings.

DESCRIPTION OF THE EMBODIMENTS

Figure 1:
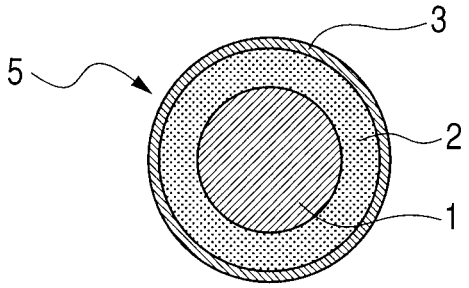
FIG. 1 is a cross-sectional view of a charging roller according to the present invention.

FIG. 1 is a cross-sectional view of a roller-shaped charging member (hereinafter also "charging roller") according to the present invention. A charging roller 5 shown in FIG. 1 has a conductive substrate 1 and layered thereon a conductive elastic layer 2 and a conductive surface layer 3 in this order.

Surface Layer

The surface layer 3 contains a binder resin and graphitized particles standing dispersed in the binder resin. The graphitized particles have a graphite (002) plane lattice spacing of from 0.3362 nm or more to 0.3449 nm or less. The binder resin contains in the molecule a urethane linkage or a siloxane linkage, or a urethane linkage and a siloxane linkage.

The reason is explained below why the surface layer according to the present invention can well keep the graphitized particles from moving in the substrate, even because of its repeated expansion and contraction.

The present inventors have conducted the following experiment on a charging roller having i) a conductive elastic layer made up of a rubber having a unit coming from ethylene oxide and ii) a conductive surface layer containing a urethane resin and graphitized particles dispersed in the urethane resin; the surface layer covering the conductive elastic layer.

That is, a plurality of charging rollers were readied which have the same make-up except that graphitized particles having different graphite (002) plane lattice spacings were used as the graphitized particles contained in the surface layer. Then, these charging rollers were used for an environmental test. Stated specifically, these charging rollers were placed in an environment of temperature 23° C. and humidity 55% RH (hereinafter also "N/N environment") for 24 hours, and then placed in an environment of temperature 40° C. and humidity 95% RH for 30 days, and further placed in the N/N environment for 7 days. Then, how the graphitized particles stood in the surface layer of each charging roller used for such an environmental test was observed on an electron microscope to examine any change in state of dispersion of the graphitized particles in the surface layer before and after the environmental test. As the result, surface layers making use of the graphitized particles having a graphite (002) plane lattice spacing in the range of from 0.3362 nm to 0.3449 nm were found to show very less changes in state of dispersion in the surface layer before and after the environmental test. The like results were also obtained about a plurality of charging rollers prepared in the same way except that the urethane resin was changed for dimethylpolysiloxane in the above experiment.

From these results of experiment, it is considered that, in the surface layer containing the graphitized particles having a graphite (002) plane lattice spacing of from 0.3362 nm to 0.3449 nm, the position of graphitized particles that is relative to the binder resin present around the graphitized particles stands substantially immobilized. Hence, the graphitized particles stand well kept from moving in the conductive surface layer, even because of its repeated expansion and contraction, as so presumed. Thus, it is presumed that such immobilization comes as a result of the intercalation of urethane resin or silicone resin between layers of a stack of hexagonal net planes the graphitized particles have.

Here, the technical significance of numerical values of the graphite (002) plane lattice spacing of the graphitized particle should be confirmed. In a publication "Carbon Black Handbook, 3rd Edition" (Apr. 15, 1995, published by Carbon Black Association), page 56, line 12, it is described that a graphite having a perfect graphite structure wherein hexagonal net planes of carbon atoms stand stacked up with regularity has a (002) plane lattice spacing of 3.354 angstroms. In the same publication, page 56, line 11, it is also described that a carbon precursor the crystal structure of which has not so much developed as graphite has a plane lattice spacing of from 3.47 to 3.60 angstroms. As still also shown in a publication "Properties and Optimum Combination of Carbon Black and Application Techniques" (May 26, 1997, published by Technical Information Institute Co., Ltd.), page 8, FIG. 9, it is described that those in which layers arranged in 6-membered ring networks of carbon atoms like carbon black do not stand regularly arranged have a plane lattice spacing of 0.365 nm (3.65 angstroms).

From the foregoing, it can be seen that the value of the graphite (002) plane lattice spacing is a parameter that shows the degree of development in the crystallization of graphitized particles. Thus, the range of numerical values of the plane lattice spacing according to the present invention is that which specifies graphitized particles having a laminar structure wherein aromatic-network planes stand fairly highly regularly stacked up but their regularity is not so perfect as commonly available graphite has. Now, carbon having an imperfectly stacked laminar structure is presumed to have portions with partially broadened layer spacing as illustrated on the second from right in FIG. 1.4 on page 56 of the publication "Carbon Black Handbook, 3rd Edition" (Apr. 15, 1995, published by Carbon Black Association) or have partial imperfection as illustrated on the second from right in the same.

Then, it is considered that polar groups such as carboxyl groups and oxygen are present at such layer spacing broadened portions or imperfection portions. In the present invention, it is considered that the binder resin stands intercalated between layers of the graphitized particles in virtue of affinity between the polar groups present at the layer spacing broadened portions or imperfection portions and the urethane linkage or siloxane linkage. On the other hand, any graphite the plane lattice spacing of which is 0.3354 nm has a very small possibility for the binder resin to be intercalated between layers, because it has too small interlaminar distance and also the polar groups having stood present between the layers are almost decomposed in the course the carbon precursor is graphitized. This is supported also from the description in Japanese Patent Laid-open Application No. 2004-217450, paragraph [0003], that "graphite is . . . a substance having a strongly anisotropic laminar structure with a layer plane lattice spacing of 0.335 nm" and "any reaction that may attack in-plane linkages may not easily proceed.

Meanwhile, as regards the plane lattice spacing, graphitized particles become lower in their conductivity as the plane lattice spacing becomes larger from the plane lattice spacing of 0.3354 nm the perfect graphite has. That is, in the crystal structure of graphitized particles wherein the hexagonal net planes stand stacked up, the graphitized particles are known to have a high conductivity because of the presence of Π-electrons that move like free electrons over in-planes of that hexagonal net planes (see "Hitachi Powder Metallurgy Technical Report No. 3 (2004)", page 2, right column, lines 2 to 6). Hence, the movement of Π-electrons is retarded with an increase in interlaminar distance, and the lowering of conductivity comes on.

As described above, the range of numerical values of the graphite (002) plane lattice spacing of the graphitized particles according to the present invention has the technical significance that it specifies graphitized particles having a good conductivity and suited to make the binder resin intercalated between layers.

It is preferable for the graphitized particles to have an average particle diameter of from 0.5 μm to 15 μm, and particularly from 1 μm to 8 μm, because the flow of electric current in the charging member can be controlled and further the effect of keeping the electrical resistance from varying can be brought out. It is also much preferable for the graphitized particles to have a length/breadth ratio of 2 or less. Taking this range enables easier control of the flow of electric current in the charging member. At the same time, it enables blotches to be more surely kept from occurring on electrophotographic images because of any excess discharge or discharge insufficiency. Further, it is much preferable that, representing the average particle diameter (μm) of the graphitized particles by A, graphitized particles having particle diameter in the range of from 0.5 A or more to 5 A or less hold 80% or more of the whole graphitized particles. This suggests that it is much preferable for the graphitized particles to have a sharp particle size distribution. Taking this range enables easier control of the flow of electric current in the charging member and at the same time also enables the above blotches to be more surely kept from occurring.

The graphitized particles may be held in the surface layer in a content of from 1% to 50%, and preferably from 2% to 30%, as volume occupancy. Taking this range more remarkably brings out the effect of keeping the surface layer from expanding by heat and/or water, and also enables easier control of the flow of electric current in the charging member and at the same time also enables the above blotches to be more surely kept from occurring.

The graphitized particles may preferably be mixed in an mount of from 0.5 part by mass to 50 parts by mass, much preferably 1 part by mass or more, and particularly preferably from 2 parts by mass to 30 parts by mass, based on 100 parts by mass of the binder resin. Taking this range enables control of the volume occupancy in the preferable range. Thus, this can more remarkably bring out the effect of keeping the surface layer from expanding by heat and/or water. This also enables easier control of the flow of electric current in the charging member and at the same time also enables the above blotches to be more surely kept from occurring.

The graphitized particles are a substance containing carbon atoms which make laminar structure by SP2 covalent bonding. The graphitized particles may also preferably be those having a peak intensity half width of 80 $cm^{-1}$ or less, and much preferably 60 $cm^{-1}$ or less, at a peak of 1,580 $cm^{-1}$ in Raman spectrum as coming from graphite.

Artificial graphitized particles may favorably be used as the graphitized particles. Stated specifically, graphitized particles may be used which are obtained by graphitizing carbon precursors obtained from, e.g., coke, tar pitch, bulk-mesophase pitch and mesocarbon microbeads. How to produce the graphitized particles according to the present invention is generally described below.

Particles Obtained by Graphitizing Coke, Etc

Obtained by adding a binder such as pitch to filler such as coke and molding these, followed by firing. As the filler, coke may be used which, e.g., is obtained from green coke obtained by heating residual oil left in petroleum distillation, or coal tar pitch, at about 500° C., which green coke is further fired at 1,200° C. or more to 1,400° C. or less. As the binder, pitch may be used which, e.g., is obtained as a distillation residue of tar.

As a method of obtaining the graphitized particles by using coke, coke particles, e.g., are so pulverized as to be about 10 μm in volume average particle diameter, and then mixed with a resin containing oxygen atoms in the molecule (e.g., furan resin). Thereafter, the mixture obtained is kneaded with heating at about 150° C. Thereafter, the kneaded product obtained is mechanically so pulverized as to be about 20 μm in volume average particle diameter. The pulverized product obtained is treated by heating at 700 to 1,000° C. Next, this treated product may further be treated by heating at 2,600 to 3,000° C. for about to 20 minutes to obtain the graphitized particles according to the present invention. Here, the higher the heating temperature is, the smaller the plane lattice spacing becomes, and also, the longer the time for heat treatment is, the smaller the plane lattice spacing becomes. Accordingly, the temperature and time for heat treatment may appropriately be controlled within the above ranges.

Particles Obtained by Graphitizing Bulk-Mesophase Pitch

The bulk-mesophase pitch may be obtained by, e.g., extracting β-resin from coal-tar pitch or the like by solvent fractionation and hydrogenating this β-resin to carry out heavy-duty treatment. After its heavy-duty treatment, this may also be pulverized, followed by removal of the solvent-soluble matter by using benzene, toluene or the like. This bulk-mesophase pitch may preferably have 95% by weight or more of quinoline-soluble matter. If one having less than 95% by weight of the same is used, the interiors of particles can not easily be liquid-phase carbonized, and may come solid-phase carbonized to form particles whose shape is kept crushed. In order to make the length/breadth ratio small, it is preferable to make the above control.

As a method of obtaining the graphitized particles by using mesophase pitch, the above bulk-mesophase pitch is pulverized, and the particles obtained are treated by heating in air at 200 to 350° C. to carry out oxidation treatment lightly. This oxidation treatment makes the bulk-mesophase pitch particles infusible only at their surfaces, and the particles are prevented from melting or fusing at the time of treatment for graphitization in the next step. For the bulk-mesophase pitch particles having been subjected to oxidation treatment, it is suitable to have an oxygen content of from 5% by mass or more to 15% by mass or less. Next, the bulk-mesophase pitch particles having been subjected to oxidation treatment are treated by heating at 1,000° C. or more to 3,500° C. or less for 10 to 60 minutes in an inert atmosphere of nitrogen, argon or the like to obtain the desired graphitized particles. In the case when the bulk-mesophase pitch is used as the carbon precursor, too, the higher the heating temperature at the time of heat treatment is, the smaller the plane lattice spacing becomes, and also, the longer the time for heat treatment is, the smaller the plane lattice spacing becomes. Accordingly, the temperature and time for heat treatment may appropriately be controlled within the above ranges.

Particles Obtained by Graphitizing Mesocarbon Microbeads

As a method of obtaining mesocarbon microbeads, a method is available in which coal type heavy oil or petroleum type heavy oil is treated by heating at a temperature of from 300° C. or more to 500° C. or less to effect polycondensation to form crude mesocarbon microbeads, and thereafter the reaction product is subjected to treatment such as filtration, sedimentation by leaving at rest, or centrifugation, to separate mesocarbon microbeads, followed by washing with a solvent such as benzene, toluene or xylene and further followed by drying.

To obtain graphitized particles by using such mesocarbon microbeads, first the mesocarbon microbeads having been dried are kept mechanically primarily dispersed by a force mild enough not to break them. This is preferable in order to prevent particles from coalescing after graphitization or obtain uniform particles. The mesocarbon microbeads having been thus kept primarily dispersed are primarily heated at a temperature of from 200 to 1,500° C. in an inert atmosphere to undergo carbonization. The carbonized product thus obtained is mechanically dispersed also by a force mild enough not to break them. This is preferable in order to prevent particles from coalescing after graphitization or obtain uniform particles. The carbonized product having been thus dispersed is secondarily heated at 1,000 to 3,500° C. for 10 to 60 minutes in an inert atmosphere to obtain the desired graphitized particles. In the case when the mesocarbon microbeads are used as the carbon precursor, too, the higher the heating temperature at the time of heat treatment is, the smaller the plane lattice spacing becomes, and also, the longer the time for heat treatment is, the smaller the plane lattice spacing becomes. Accordingly, the temperature and time for heat treatment may appropriately be controlled within the above ranges.

Binder Resin

The binder resin is required to have in the molecule a urethane linkage or a siloxane linkage, or a urethane linkage and a siloxane linkage. As described previously, the urethane linkage moiety and the siloxane linkage moiety are to make them play an important role in the intercalation of the binder resin between layers of the graphitized particles according to the present invention. As a specific resin, it may be exemplified by polyurethane resin and silicone resin.

The surface layer containing the polyurethane resin may be formed by coating the surface of the elastic layer with a surface layer forming coating solution which contains the above graphitized particles, a polyol and a compound having an isocyanate group, and allowing the polyol to react with the compound having an isocyanate group.

The surface layer containing the silicone resin may also be formed by coating the surface of the elastic layer with a surface layer forming coating solution which contains the above graphitized particles and a hydrolyzable organosiloxane, and allowing the organosiloxane to undergo dehydration condensation or dealcohol condensation. Here, the hydrolysable organosiloxane may include silane compounds having two or three hydrolysable groups in the molecule, such as a trialkoxysilane and a dialkoxysilane. The silane compounds having two or three hydrolysable groups in the molecule are preferable because they can make the binder resin flexible.

Further, a resin the urethane linkage and/or siloxane linkage of which has or have been grafted is preferable as the binder resin according to the present invention. The intercalation of the binder resin into the graphitized particles is presumed to stand taken place in parallel to the formation of urethane linkages and/or siloxane linkages in the coating of the coating solution with which the surface of the elastic layer has been coated. Here, the urethane linkages and/or siloxane linkages are present at grafted moieties in the coating which are high in freedom of movement, in virtue of which the binder resin can more efficiently intercalated into the graphitized particles. Stated specifically, there may be given a constitution in which, as shown in the following structural formula (I) or (II), a hard segment (backbone chain) is an acrylic resin or styrene resin having a carbon-carbon bond and the resin has the urethane linkage or siloxane linkage on a soft segment (side chain) attached to the backbone chain.

Structural formula (I)

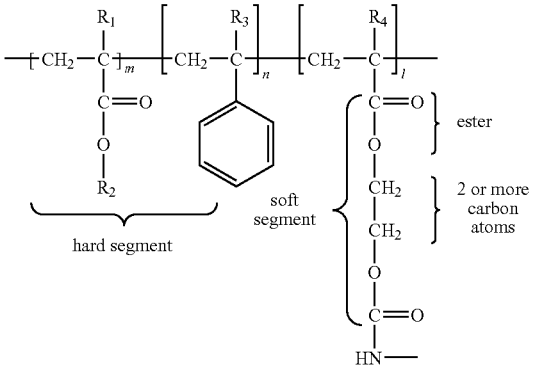

-continued

Structural formula (II)

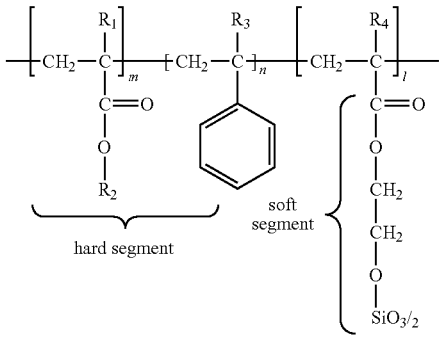

In the above structural formulas (I) and (II), $R_1$ to $R_4$ each independently represent a hydrogen atom, an alkyl group having 1 to 3 carbon atoms or a halogen atom, m and n represent integers of 0 or more, and l represents an integer of 1 or more.

The graft polymer having a urethane linkage on the side chain may be synthesized by allowing a polyol having the backbone chain formed of an acrylic resin or styrene resin and having a hydroxyl group on the side chain, to react with a compound having an isocyanate group. It is preferable that the part where the backbone chain is linked with the side chain is an ester linkage and further that an alkylene group having 2 or more carbon atoms is made present between that ester linkage and the urethane linkage or siloxane linkage. This is because the side chain in the coating can be provided with a higher freedom of movement. Such a graft polymer may be synthesized by allowing a polyol having the backbone chain formed of an acrylic resin or styrene resin and having on the side chain the alkylene group having 2 or more carbon atoms, to which alkylene group a hydroxyl group is bonded through an ester group or the like, to react with the compound having an isocyanate group.

The polyol used here may be synthesized by adding a hydroxyl group-containing acrylate such as a hydroxyalkyl methacrylate or a hydroxyalkyl acrylate to an acrylic monomer or styrene monomer to effect polymerization. As the polyol, ϵ-caprolactone modified polyol may also be used in which, using an ester group, a side chain having an alkylene group and a hydroxyl group has been introduced into the backbone chain formed of an acrylic resin or styrene resin. Such an ϵ-caprolactone modified polyol is known in the art as, e.g., PLACCEL DC2016 (trade name), available from Daicel Chemical Industries, Ltd.).

The compound having an isocyanate group may be exemplified by the following compounds: Aliphatic diisocyanates such as hexamethylene diisocyanate and trimethylhexamethylene diisocyanate, alicyclic diisocyanates such as isophorone diisocyanate, aromatic aliphatic diisocyanates such as xylylene diisocyanate, and aromatic diisocyanates such as tolylene diisocyanate and 4,4'-diphenylmethane diisocyanate; and dimers, and trimers, of any of these diisocyanates. Of the foregoing, aliphatic diisocyanates are preferred in order to obtain a urethane resin having a side chain with a higher freedom of movement. Also, in order to form the urethane linkage in steric order to enhance the effect of keeping the graphitized particles from changing in position, it is particularly preferable to use a trimer.

Meanwhile, the graft polymer having a siloxane linkage on the side chain may be obtained by allowing a polyol having a hydroxyl group on the side chain and a mixture of, e.g., a trialkoxysilane and a dialkoxysilane to undergo dehydration condensation or dealcohol condensation. It may also be obtained by adding a siloxane bond-containing acrylate such as silicone modified methacrylate or silicone modified acrylate to an acrylic monomer or styrene monomer to effect polymerization.

The urethane linkage and/or the siloxane linkage may preferably be contained in an amount of 2% by mass or more, based on the total mass of the binder resin. This can more readily bring out the effect of immobilizing the graphitized particles in virtue of the intercalation of the binder resin into the graphitized particles.

Any of these resins may also be mixed in a binder resin different from the foregoing. As such a different binder resin, any known binder resin may be employed. For example, it may include fluorine resins, polyamide resins, acrylic resins and butyral resins. A rubber such as natural rubber, natural rubber having been vulcanized or a synthetic rubber may also be added.

In the surface layer, it is preferable that at least 80% of the graphitized particles in total number are present at intervals of from 10 μm or more to 100 μm or less. This can more remarkably bring out the effect of keeping the surface layer from expanding by heat and/or water. This also enables easier control of the flow of electric current in the charging member and at the same time enables the blotches to be more surely kept from occurring.

The surface layer may preferably be so controlled as to have a volume resistivity of approximately from $1\times10^{2}$ Ω·cm to $1\times10^{15}$ Ω·cm in an environment of 23° C. and 50% RH. The volume resistivity of the surface layer is determined in the following way.

First, the surface layer is stripped from the roller member, and cut in a rectangular shape of about 5 mm×5 mm in size. A metal is vacuum-deposited on its both sides to form an electrode and a guard electrode to obtain a sample for measurement. In another way, an aluminum sheet is coated thereon with a solution to form a surface layer coating, and a metal is vacuum-deposited on the coating surface to obtain a sample for measurement. To the sample for measurement, a voltage of 200 V is applied by using a micro-current meter "ADVANTEST R8340A Ultra-high Resistance Meter" (trade name; manufactured by Advantest Co., Ltd.). Then, electric current after 30 seconds is measured, and calculation is made from layer thickness and electrode area to find the volume resistivity.

As conductive particles other than the graphitized particles according to the present invention, any known ionic conductive agent or electronic conductive agent may be used as long as the object of the present invention is not failed. For example, the ionic conductive agent may include quaternary ammonium perchlorate, which makes the surface layer not easily vary in electrical resistance against environments. The electronic conductive agent may include known conductive carbon black.

The surface layer may further be incorporated with insulating particles as long as the effect of the present invention is not failed. The surface layer may also be incorporated with a release agent in order to improve the releasability of the surface of the charging member. Incorporation of the release agent in the surface layer can prevent any stain from sticking to the surface of the charging member, and hence can bring an improvement in durability (running performance) of the charging member. It also makes relative movement smooth between the charging member and the electrophotographic photosensitive member, and hence makes any state of irregular movement such as stick slip less occur, so that any irregular wear of the surface of the charging member, noise (abnormal sound) and so forth can be kept from occurring. Where the release agent is a liquid, it acts also as a leveling agent when the surface cover layer is formed.

As the release agent as above, those having low surface energy and those having slidability may be used, and, as their properties, those which are liquid or solid may be used. Stated specifically, it includes metal oxides such as molybdenum disulfide, tungsten disulfide, boron nitride and lead monoxide. Also usable are compounds containing silicon or fluorine in the molecule may also be used which are in an oil form or a solid form (releasing resin or powder, or a polymer into part of which a moiety having releasability has been introduced); and also waxes, higher fatty acids, and salts or esters and other derivatives thereof.

The surface layer may preferably have a layer thickness of from 0.1 μm to 100 μm, and particularly from 1 μm to 50 μm. The layer thickness of the surface layer may be measured by observing on an optical microscope or electron microscope a roller section having been cut out with any sharp cutlery. The surface layer may be one having been surface-treated. Such surface treatment may include surface working treatment making use of ultraviolet rays or electron rays, and surface modification treatment in which a compound is made to adhere to the surface and/or the latter is impregnated with the former.

Figure 2A:
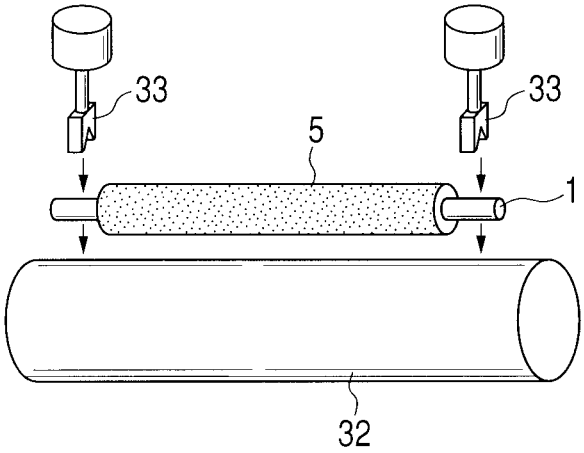
FIGS. 2A and 2B illustrate how to measure the value of electrical resistance of the charging roller according to the present invention.
Figure 2B:
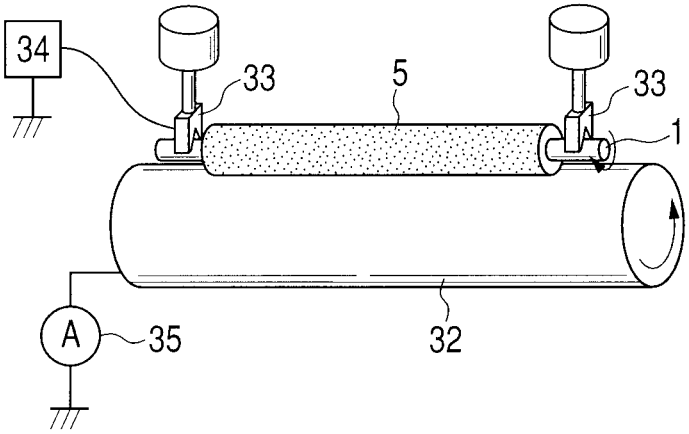

In order for the electrophotographic photosensitive member to be well electrostatically charged, the charging roller may usually preferably have an electrical resistance of from $1\times10^{2}$Ω or more to $1\times10^{10}$Ω or less in an environment of temperature 23° C. and humidity 50% RH. How to measure the electrical resistance of the charging roller is shown in FIGS. 2A and 2B. A load is kept applied at both end portions of a conductive substrate of a charging roller 5 through bearings 33, where the charging roller 5 is brought into contact with a cylindrical metal 32 having the same curvature as the electrophotographic photosensitive member, in such a way that the former is in parallel to the latter. In this state, the cylindrical metal 32 is rotated by means of a motor (not shown), and, while the charging roller 5 kept in contact is allowed to be follow-up rotated, a DC voltage of −200 V is applied thereto from a stabilized power source 34. Electric current flowing at this time is measured with an ammeter 35 and the electrical resistance of the charging roller is calculated. In this working example, the load is set at 4.9 N for each end, the cylindrical metal 32 is 30 mm in diameter, and the cylindrical metal 32 is rotated at a peripheral speed of 45 mm/sec.

From the viewpoint of making lengthwise nip width uniform to the electrophotographic photosensitive member, the charging roller may preferable be in what is called a crown shape, a shape in which the roller is thickest at the middle in its lengthwise direction and is thinner as it comes to the both ends in its lengthwise direction. As a crown level, the difference in external diameter between that at the middle portion and that at positions at least 90 mm away from the middle portion may preferably be from 30 μm or more to 200 μm or less.

The charging roller may much preferably have a surface ten-point average roughness Rzjis of from 2 μm or more to 30 μm or less and a surface average concave to convex distance Rsm of from 15 μm or more to 150 μm or less. Setting the surface ten-point average roughness Rzjis and surface average concave to convex distance Rsm of the charging roller within these ranges can make stabler the state of contact between the charging roller and the electrophotographic photosensitive member. This is much preferable because the electrophotographic photosensitive member can readily uniformly electrostatically be charged.

The surface ten-point average roughness Rzjis and the surface average concave to convex distance Rsm are measured with surface profile analyzer "SE-3400" (trade name; manufactured by Kosaka Laboratory Ltd.) according to Japan Industrial Standards (JIS) B 0601-2001. Here, the Rzjis is an arithmetic mean value of values found by measuring the surface of the charging roller at 6 spots at random. As to the Rsm, 6 spots on the surface of the charging roller are picked up at random, and at each spot, average concave to convex distances at ten points in the each spot are measured, and then an average thereof is taken as Rsm at the respective spots, thus the Rsm of the surface of the charging roller is an arithmetic mean value of Rsm values at 6 spots. In measuring the Rzjis and Rsm, standard length is set to be 8 mm, and cut-off value 0.8 mm.

Substrate

The substrate 1 has conductivity and supports the elastic layer and surface layer provided thereon. A material therefor may include metals such as iron, copper, stainless steel, aluminum and nickel, or alloys of any of these. Also usable are a substrate made of resin the surface of which has been covered with a metal or the like to make the surface conductive, and a substrate produced from a conductive resin composition.

Elastic Layer

The elastic layer 2 is provided in order to sufficiently secure the contact nip width between the charging roller and the electrophotographic photosensitive member. The elastic layer 2 contains a polymer having a unit coming from ethylene oxide. This provides the elastic layer with conductivity suited for the charging roller.

The conductivity at large that is required for the elastic layer of the charging roller is that the volume resistivity when measured in an environment of temperature 23° C. and humidity 50% RH is approximately from $10^2$ Ω·cm to $10^{10}$ Ω·cm. The volume resistivity of the elastic layer may be measured in the same way as the method of measuring the volume resistivity of the surface layer described above, by using a volume resistivity measuring sample obtained by molding all materials for the elastic layer into a sheet of 1 mm in thickness and vacuum-depositing a metal on its both sides to form an electrode and a guard electrode.

The hardness at large that is required for the elastic layer of the charging roller is approximately from 30° to 70° as microhardness (MD-1 Model). The microhardness (MD-1 Model) is the hardness that is measured with ASKER rubber microhardness meter MD-1 Model (trade name; manufactured by Kobunshi Keiki Co., Ltd.). Herein, it is the value measured with the hardness meter, which is brought into contact with the charging member in a 10 N peak hold mode; the charging member having been left for 12 hours or more in an environment of normal temperature and normal humidity (23° C., 50% RH).

Examples of the polymer having a unit coming from ethylene oxide that affords such an elastic layer are shown below: A homopolymer of ethylene oxide, a copolymer of ethylene oxide and propylene oxide, polyether esters, polyether amides, polyether ester amides, poly(ethylene glycol acrylate), poly(ethylene glycol) methyl ether, a block copolymer of poly(ethylene glycol) and polyethylene, a block copolymer of poly(ethylene glycol) and poly(propylene glycol), a block copolymer of poly(ethylene glycol) and poly (tetramethylene glycol), and epichlorohydrin rubbers.

The elastic layer 2 may also contain any of the above exemplified polymers in plurality. In particular, of the above polymers, epichlorohydrin rubbers are preferred in view of their readiness to control the electrical resistance of the elastic layer and control the hardness of the elastic layer. The epichlorohydrin rubbers have conductivity in a medium resistance region by themselves, and stated specifically, of approximately from $1.0\times10^9$ Ω·cm to $1.0\times10^5$ Ω·cm in volume resistivity. Hence, when the elastic layer is made conductive, they make it unnecessary for any conductive agent to be added to the elastic layer, or enable it to be added in a small quantity. This is advantageous to the elastic layer to keep it flexible.

Specific examples of such epichlorohydrin rubbers are given below: An epichlorohydrin homopolymer, an epichlorohydrin-ethylene oxide copolymer, an epichlorohydrin-allylglycidyl ether copolymer and an epichlorohydrin-ethylene oxide-allylglycidyl ether terpolymer. Of these, an epichlorohydrin-ethylene oxide-allylglycidyl ether terpolymer may preferably be used because it exhibits especially stable conductivity in the medium resistance region. The epichlorohydrin-ethylene oxide-allylglycidyl ether terpolymer can control conductivity and workability by controlling its polymerization degrees and compositional ratios. Also, an elastic layer is particularly preferred in which a polymer containing 30% by mass or more of the unit coming from ethylene oxide has been incorporated in an amount of 40% by mass or more, based on the total mass of the epichlorohydrin-ethylene oxide-allylglycidyl ether terpolymer. This is because the elastic layer can stably be made to have its volume resistivity within the above range. The amount of the unit coming from ethylene oxide in the polymer may be calculated by using $^1$H-NMR and $^{13}$C-NMR.

The elastic layer 2 may further contain other polymer. Such other polymer may include commonly available rubbers. Examples of other polymer are given below: EPM (ethylene-propylene rubber), EPDM (ethylene-propylene-diene terpolymer), NBR (acrylonitrile-butadiene copolymer rubber), chloroprene rubber, natural rubber, isoprene rubber, butadiene rubber, styrene-butadiene rubber, urethane rubber, silicone rubber, SBS (styrene-butadiene-styrene block copolymer) and SEBS (styrene-ethylenebutylene-styrene block copolymer).

For the controlling of the volume resistivity of the elastic layer 2, an ionic conductive agent or electronic conductive agent may appropriately be added thereto. Where the elastic layer contains a polar rubber, an ammonium salt may preferably be used as the conductive agent. The elastic layer 2 may further contain insulating particles, an age resistor and a filler in order to control its hardness and provide it with various functions.

The elastic layer may be formed by bonding to the conductive substrate, or covering it with, a sheet or tube obtained by beforehand forming elastic layer materials into it in a stated layer thickness. It may also be produced by extruding the conductive substrate and the elastic layer materials integrally, using an extruder having a cross head. The elastic layer may, for forming the surface layer thereon, further be subjected to surface working treatment making use of ultraviolet rays or electron rays or surface modification treatment in which a compound is made to adhere to the surface and/or the latter is impregnated with the former.

Intermediate Layer, Etc.

The charging member according to the present invention may have an intermediate layer between the elastic layer 2 and the surface layer 3. This is effective in keeping any low-molecular components such as a softening oil and a plasticizer which are contained in the elastic layer, from bleeding out to the surface of the charging member. A conductive adhesive layer may also be provided between the elastic layer 2 and the surface layer 3.

Charging Member Production Process

The process for producing the charging member has the step of coating by a known method the surface of the elastic layer, or the surface of the intermediate layer, with a surface layer forming coating solution which contains the graphitized particles, a binder resin raw material and necessary other components that have been described above, and allowing the binder resin raw material to react. The coating method may include as examples thereof electrostatic spray coating and dip coating. Instead, the charging member may also be produced by forming a sheet or tube by using the surface layer forming coating solution, and bonding this sheet or tube to the surface of the elastic layer or the like. Further, the charging member may also be produced by injecting an elastic layer raw material described later, into a hollow mold on the inner surface of which a coating of the surface layer forming coating solution has been formed, and curing the elastic layer raw material and the coating.

As a solvent used for the surface layer forming coating solution, any solvent may be used as long as it can dissolve the binder resin. Stated specifically, it may include the following: Alcohols such as methanol, ethanol and isopropanol; ketones such as acetone, methyl ethyl ketone and cyclohexanone; amides such as N,N-dimethylformamide and N,N-dimethylacetamide; sulfoxides such as dimethyl sulfoxide; ethers such as tetrahydrofuran, dioxane, and ethylene glycol monomethyl ether; esters such as methyl acetate and ethyl acetate; and aromatic compounds such as xylene, chlorobenzene and dichlorobenzene.

As means by which the binder resin, the conductive agent, insulating particles and so forth are dispersed in the coating solution, usable are known solution dispersing means such as a ball mill, a sand mill, a paint shaker, Daino mill and Pearl mill.

Electrophotographic Apparatus

Figure 3:
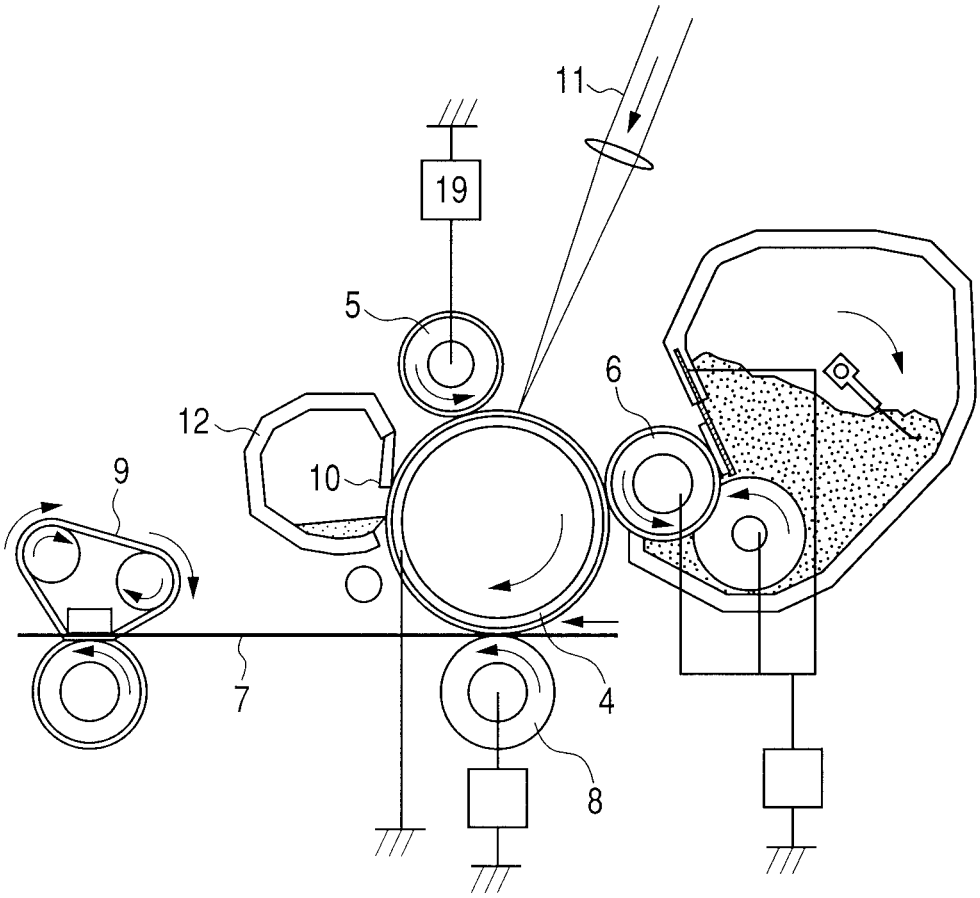
FIG. 3 is a cross-sectional view of an electrophotographic apparatus according to the present invention.

FIG. 3 shows a cross section of an electrophotographic apparatus having a charging roller 5 according to the present invention. An electrophotographic photosensitive member 4 is rotated at a stated peripheral speed (process speed) in the direction shown by an arrow. The charging roller 5 is in contact with the electrophotographic photosensitive member 4 at a stated pressing force. The charging roller 5 is follow-up rotated with the rotation of the electrophotographic photosensitive member 4. Then, a stated DC voltage is applied to the charging roller 5 from a power source 19 to charge the electrophotographic photosensitive member 4 electrostatically to a stated potential. The electrophotographic photosensitive member 4 thus charged is exposed to laser light 11 in accordance with image information to form an electrostatic latent image thereon. The electrostatic latent image is developed with a toner held on a developing roller 6 provided in contact with the electrophotographic photosensitive member 4, to form a toner image thereon. A transfer assembly has a contact type transfer roller 8. The toner image is transferred to a transfer material 7 such as plain paper. A cleaning unit has a cleaning blade 10 and a collecting container 12, where any transfer residual toner remaining on the electrophotographic photosensitive member 4 is scraped off by the cleaning blade 10 and collected in the collecting container 12. Here, the transfer residual toner may be collected at a developing assembly so as not to provide the cleaning blade 10 and the toner collecting container 12. A fixing assembly 9 is constituted of a roll or the like to be kept heated, and fixes to the transfer material 7 the toner image having been transferred thereto. In the electrophotographic apparatus according to the present invention, it is preferable for the apparatus to be so set up that only DC voltage is applied to the charging member whereby the electrophotographic photosensitive member can electrostatically be charged.

Process Cartridge

Figure 4:
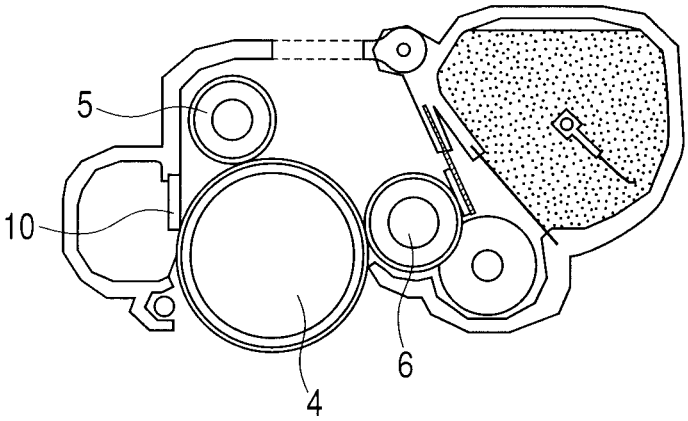
FIG. 4 is a cross-sectional view of a process cartridge according to the present invention.

FIG. 4 shows a cross section of a process cartridge in which a charging roller 5 according to the present invention and an electrophotographic photosensitive member 4 are fitted in the state they are in contact with each other. This process cartridge is so set up as to be detachably mountable to the main body of the electrophotographic apparatus. The process cartridge shown in FIG. 4 further has a developing roller 6, a cleaning blade 10 and so forth.

EXAMPLES

The present invention is described below in greater detail by giving specific working examples. How to measure various parametric values measured in the present working examples is described first.

Measurement of Graphite (002) Plane Lattice Spacing of Graphitized Particles Per Se and Graphitized Particles Contained in Surface Layer About the plane lattice spacing of Graphitized particles 1 to 32 described later, it is measured with a sample horizontal type high-intensity X-ray diffraction instrument (trade name: RINT/TTR-II; manufactured by Rigaku Corporation) under the following conditions to obtain an X-ray diffraction chart. About the plane lattice spacing of graphitized particles contained in the surface layer, first about 50 mg of graphitized particles are picked from the surface layer. This is measured with the above instrument to obtain an X-ray diffraction chart.

A peak position of diffraction profiles from graphite (002) planes is determined from each X-ray diffraction chart, and the graphite (002) plane lattice spacing, graphite d(002), is calculated by using Bragg equation shown by the following Expression (1). The results are shown in Table 1.

$$\text{Graphite } d(002)=\lambda/(2\times\sin\theta). \qquad \text{Expression (1)}$$

Measurement Conditions

Sample weight: 50 mg.
Ray source: CuKα rays (wavelength λ: 0.15418 nm).
Optical system: Parallel beam optical system.
Goniophotometer: Rotor horizontal goniophotometer (TTR-2).
Tube voltage/current: 50 kV/300 mA.
Measuring method: Continuous method.
Scanning axis: 2θ/θ.
Measurement angle: 10° to 50°.
Sampling intervals: 0.02°.
Scanning rate: 4°/min.
Divergence slit: Open.
Divergence vertical slit: 10 mm.
Scattering slit: Open.
Acceptance slit: 1.00 mm.

Measurement of Raman Spectrum Half Width of Graphitized Particles Per Se and Graphitized Particles Contained in Surface Layer About particles contained in the surface layer, graphitized particles picked from the surface layer are used as a measuring sample. The graphitized particles per se are used as they are, as a measuring sample. These samples are measured with Raman spectrometer (trade name: LabRAM HR; manufactured by HORIBA Jobin Yvon Inc.) under the following measurement conditions. In this measurement, the band width of a Raman band at a height corresponding to ½ of a peak present in the region of from 1,570 to 1,630 $cm^{-1}$.

Chief Measurement Conditions

Laser: He—Ne laser (peak wavelength: 632 nm).
Filter: D0.3.
Hole: 1,000 μm.
Slit: 100 μm.
Central spectrum: 1,500 $cm^{-1}$.
Measurement time: 1 second×16 times.
Grating: 1,800.
Objective lens: ×50.

Measurement of Three-Dimensional Particle Shape of Graphitized Particles, Conductive Agent and Insulating Particles Contained in Corresponding Layers Each layer is cut out with focused ion beam instrument "FB-200C" (trade name; manufactured by Hitachi Ltd.) over an extent of 500 μm at an arbitrary spot and at intervals of 20 nm, and their sectional images are photographed. Then, images obtained by photographing the same particles are combined at intervals of 20 nm, and their three-dimensional particle shape is calculated. This is operated at arbitrary 100 spots of each layer.

Average Particle Diameter A of Particles Contained in Each Layer

Projected area is calculated from the three-dimensional particle shape obtained as above, and circle-equivalent diameter of the area obtained is calculated. Volume average particle diameter is determined from this circle-equivalent diameter, which is taken as average particle diameter A. Particle size distribution of the above graphitized particles is distribution as this volume average particle diameter.

Ratio of Major Axis to Minor Axis of Graphitized Particles Contained in Surface Layer This is an average value of the values of maximum diameter/minimum diameter of the above three-dimensional particle shape.

Volume Occupancy of Graphitized Particles Contained in Surface Layer

Proportions in which the sum of volumes of the above three-dimensional particle shape is held with respect to the whole volume of the binder are calculated, and an average value of the values found is taken as volume occupancy.

Presence Distance of Graphitized Particles Contained in Surface Layer

About the three-dimensional particle shape of the graphitized particles, the centers of gravity are each calculated, and the distances between the centers of gravity and the centers of gravity of adjacent graphitized particles are calculated. An average value thereof is taken as presence distance of the graphitized particles.

Measurement of Average Particle Diameter of Graphitized Particles, Conductive Agent and Insulating Particles Per Se About only primary particles from which any articles standing secondarily agglomerate, 100 particles are observed on a transmission electron microscope (TEM) to determine their projected area, and the circle-equivalent diameter of the area obtained is calculated to find volume average particle diameter. Their particle size distribution is distribution found when this volume average particle diameter is found.

The Ratio of Major Axis to Minor Axis of Graphitized Particles Per Se

About the 100 particles observed, their values of maximum diameter/minimum diameter are calculated, and an average value thereof is taken as the length/breadth ratio.

A: Production of Graphitized Particles

Production Example A1

Production of Graphitized Particle 1

β-Resin was extracted from coal-tar pitch by solvent fractionation and this was hydrogenated to carry out heavy-duty treatment. Next, its solvent-soluble matter was removed by using toluene, to obtain bulk-mesophase pitch. The bulk-mesophase pitch obtained was mechanically so pulverized as to be 3 μm in volume average particle diameter. Next, the bulk-mesophase pitch obtained was heated in air up to 270° C. at a heating rate of 300° C./hour to effect oxidation. Subsequently, the bulk-mesophase pitch thus pulverized and oxidized was heated in an atmosphere of nitrogen up to 3,000° C. at a heating rate of 1,500° C./hour, and then heated at this temperature of 3,000° C. for 15 minutes, followed by classification to obtain Graphitized particle 1.

Production Example A2

Production of Graphitized Particle 2

In Production Example A1, the bulk-mesophase pitch was mechanically so pulverized as to be 1 μm in volume average particle diameter, and conditions for the treatment in the step of oxidation in Production Example A1 were changed to heating to 2,000° C. at a heating rate of 1,000° C./hour. Also, conditions for the treatment in the step of heating were changed to a temperature of 2,000° C. for 10 minutes and conditions for the subsequent classification were changed. Except for these, the procedure of Production Example A1 was repeated to obtain Graphitized particle 2.

Production Example A3

Production of Graphitized Particle 3

Crude mesocarbon microbeads formed by heat treatment of coal type heavy oil was centrifuged, and then washed with benzene, followed by drying. The crude mesocarbon microbeads obtained were mechanically primarily dispersed by means of an atomizer mill to obtain mesocarbon microbeads. The mesocarbon microbeads obtained were heated in an atmosphere of nitrogen up to 1,200° C. at a heating rate of 600° C./hour to effect carbonization. The carbonized product obtained was secondarily so dispersed as to be about 6 μm in average particle diameter by means of the atomizer mill. The dispersed product obtained was heated in an atmosphere of nitrogen up to 2,800° C. at a heating rate of 1,400° C./hour, and then heated at this temperature of 2,800° C. for 15 minutes, further followed by classification to obtain Graphitized particle 3.

Production Example A4

Production of Graphitized Particle 4

Coal tar was distilled to remove gas oil matter having a boiling point of 270° C. or less. To 100 parts by mass of the tar matter obtained, 85 parts by mass of acetone was mixed, and the mixture obtained was stirred at room temperature. Thereafter, insoluble matter was removed by filtration. The filtrate obtained was distilled to separate the acetone to obtain purified tar. To 100 parts by mass of the purified tar obtained, 10 parts by mass of concentrated nitric acid was added to carry out polycondensation at 350° C. for 1 hour in a reduced-pressure distillation still, further followed by heating at 480° C. for 4 hours. After cooling, the reaction product was taken out of the distillation still, and this reaction product was mechanically so pulverized as to be 4 μm in average particle diameter. The pulverized product obtained was heated in an atmosphere of nitrogen up to 1,000° C. at a heating rate of 100° C./hour, and then heated at this 1,000° C. for 10 hours (primary heating). Subsequently, the heat-treated product was heated in an atmosphere of nitrogen up to 3,000° C. at a heating rate of 10° C./hour and then heated at this temperature of 3,000° C. for 1 hour (secondary heating), further followed by classification to obtain Graphitized particle 4.

Production Example A5

Production of Graphitized Particle 5

Graphitized particle 5 was obtained in the same way as in Production Example A4 except that the reduced-pressure distillation of coal tar was carried at 480° C., the reaction product was mechanically so pulverized as to be about 3 μm in average particle diameter, and also conditions for the classification were changed.

Production Example A6

Production of Graphitized Particle 6

Graphitized particle 6 was obtained in the same way as in Production Example A3 except that the secondary dispersion in Production Example A3 was so controlled that the carbonized product was about 4 μm in average particle diameter, the dispersed product was heated up to 2,000° C. at a heating rate of 1,000° C./hour and then heated at this temperature of 2,000° C. for 15 minutes, and also conditions for the classification were changed.

Production Example A7

Production of Graphitized Particle 7

Graphitized particle 7 was obtained in the same way as in Production Example A3 except that the secondary dispersion in Production Example A3 was so controlled that the carbonized product was about 2.5 μm in average particle diameter, the dispersed product was heated up to 1,500° C. at a heating rate of 750° C./hour and then heated at this temperature of 1,500° C. for 15 minutes, and also conditions for the classification were changed.

Production Example A8

Production of Graphitized Particle 8

Graphitized particle 8 was obtained in the same way as in Production Example A1 except that the mechanical pulverization was so controlled that the bulk-mesophase pitch was about 6 μm in average particle diameter, and conditions for the classification were changed.

Production Example A9

Production of Graphitized Particle 9

Graphitized particle 9 was obtained in the same way as in Production Example A1 except that the mechanical pulverization was so controlled that the bulk-mesophase pitch was about 8 μm in average particle diameter, and conditions for the classification were changed.

Production Example A10

Production of Graphitized Particle 10

Graphitized particle 10 was obtained in the same way as in Production Example A1 except that, in the heating in Production Example A1, the bulk-mesophase pitch pulverized and oxidized was heated up to 1,000° C. at a heating rate of 500° C./hour and then heated at this temperature of 1,000° C. for 15 minutes, and conditions for the classification were changed.

Production Example A11

Production of Graphitized Particle 11

Graphitized particle 11 was obtained in the same way as in Production Example A1 except that the mechanical pulverization in Production Example A1 was so controlled that the bulk-mesophase pitch was about 7 μm in average particle diameter, and conditions for the classification were changed.

Production Example A12

Production of Graphitized Particle 12

Graphitized particle 12 was obtained in the same way as in Production Example A3 except that the secondary dispersion in Production Example A3 was so controlled that the carbonized product was about 9 μm in average particle diameter, in the secondary heating the dispersed product was heated up to 1,500° C. at a heating rate of 750° C./hour and then heated at this temperature of 1,500° C. for 15 minutes, and also conditions for the classification were changed.

Production Example A13

Production of Graphitized Particle 13

60 parts by mass of coke particles (average particle diameter: 10.6 μm), 20 parts by mass of tar pitch and 20 parts by mass of furan resin (VF303, trade name; available from Hitachi Chemical Co., Ltd.) were mixed, and agitated at 200° C. for 2 hours. This was mechanically so pulverized as to be 20 μm in average particle diameter, and thereafter the pulverized product was heated in an atmosphere of nitrogen up to 900° C. at a heating rate of 450° C./hour. Subsequently, this was heated in an atmosphere of nitrogen up to 2,000° C. at a heating rate of 1,000° C./hour, and then heated at this temperature of 2,000° C. for 10 minutes. This was further mechanically so pulverized as to be 11 μm in average particle diameter, followed by classification to obtain graphitized particle 13.

Production Example A14

Production of Graphitized Particle 14

Graphitized particle 14 was obtained in the same way as in Production Example A1 except that the mechanical pulverization in Production Example A1 was so controlled that the bulk-mesophase pitch was about 10 μm in average particle diameter, this was heated in an atmosphere of nitrogen up to 2,200° C. at a heating rate of 1,100° C./hour and then heated at this temperature of 2,200° C. for 15 minutes, and conditions for the classification were changed.

Production Examples A15 to A17

Production of Graphitized Particles 15 to 17

Graphitized particles 15 to 17 were obtained in the same way as in Production Example A3 except that, in Production Example A3, the secondary dispersion was so controlled that the carbonized product was about 14 μm, 7 μm and 2 μm, respectively, in average particle diameter, in the secondary heating the dispersed product was heated up to 1,000° C. at a heating rate of 500° C./hour and then heated at this temperature of 1,000° C. for 10 minutes, and also conditions for the classification were changed.

Production Examples A18 & A19

Production of Graphitized Particles 18 & 19

Graphitized particles 18 and 19 were obtained in the same way as in Production Example A1 except that the mechanical pulverization in Production Example A1 was so controlled that the bulk-mesophase pitch was about 5 μm and 3 μm, respectively, in average particle diameter, this was heated in an atmosphere of nitrogen up to 1,800° C. at a heating rate of 500° C./hour and then heated at this temperature of 1,800° C. for 8 minutes, and conditions for the classification were changed.

Production Example A20

Production of Graphitized Particle 20

Graphitized particle 20 was obtained in the same way as in Production Example A1 except that the mechanical pulverization in Production Example A1 was so controlled that the bulk-mesophase pitch was about 8 μm in average particle diameter, this was heated in an atmosphere of nitrogen up to 2,000° C. at a heating rate of 500° C./hour and then heated at this temperature of 2,000° C. for 30 minutes, and conditions for the classification were changed.

Production Example A21

Production of Graphitized Particle 21

To 100 parts by mass of tar pitch having been fused to soften, 5 parts by mass of Graphitized particles 2, obtained in Production Example A2, was added and mixed therewith. Next, in an atmosphere of nitrogen, this was heated at 420° C. for 12 hours with agitation. The mixture obtained was mechanically so pulverized as to be about 1 μm in average particle diameter, which was further heated in air up to 260° C. at a heating rate of 240° C./hour, and then heated at this temperature of 260° C. for 30 minutes. Subsequently, this was heated in an atmosphere of nitrogen up to 1,000° C. at a heating rate of 500° C./hour, which was further heated in an atmosphere of argon up to 3,000° C. at a heating rate of 1,000° C./hour and then heat-treated at this temperature of 3,000° C. for 10 minutes, finally followed by classification to obtain Graphitized particle 21.

Production Example A22

Production of Graphitized Particle 22

Graphitized particle 22 was obtained in the same way as in Production Example A13 except that conditions for the classification in Production Example A13 were changed.

Production Example A23

Production of Graphitized Particle 23

Graphitized particle 23 was obtained in the same way as in Production Example A15 except that the mechanical pulverization in Production Example A15 was so controlled that the carbonized product was about 0.7 μm in average particle diameter, and conditions for the classification were changed.

Production Example A24

Production of Graphitized Particle 24

Graphitized particle 24 was obtained in the same way as in Production Example A14 except that, in Production Example A14, the bulk-mesophase pitch was heated in an atmosphere of nitrogen up to 1,500° C. at a heating rate of 500° C./hour and then heated at this temperature of 1,500° C. for 15 minutes, and conditions for the classification were changed.

Production Example A25

Production of Graphitized Particle 25

Graphitized particle 25 was obtained in the same way as in Production Example A2 except that the mechanical pulverization in Production Example A2 was so controlled that the bulk-mesophase pitch was about 15 μm in average particle diameter, and conditions for the classification were changed.

Production Example A26

Production of Graphitized Particle 26

Graphitized particle 26 was obtained in the same way as in Production Example A1 except that the mechanical pulverization in Production Example A1 was so controlled that the bulk-mesophase pitch was about 0.5 μm in average particle diameter, this was heated in an atmosphere of nitrogen up to 3,000° C. at a heating rate of 1,500° C./hour and then heated at this temperature of 3,000° C. for 1 hour, and conditions for the classification were changed.

Production Example A27

Production of Graphitized Particle 27

Graphitized particle 27 was obtained in the same way as in Production Example A3 except that the secondary dispersion in Production Example A3 was so controlled that the carbonized product was about 15 μm in average particle diameter, and also conditions for the classification were changed.

Production Example A28

Production of Graphitized Particle 28

Graphitized particle 28 was obtained in the same way as in Production Example A27 except that the secondary dispersion in Production Example A27 was so controlled that the carbonized product was about 10 μm in average particle diameter, the dispersed product was heated up to 800° C. at a heating rate of 100° C./hour and then heated at this temperature of 800° C. for 5 minutes, and conditions for the classification were changed.

Production Example A29

Production of Graphitized Particle 29

Scaly graphite (CNP35, trade name; available from Ito Kokuen Co., Ltd.) was so pulverized as to be 10 μm in average particle diameter, followed by classification to obtain Graphitized particle 29.

Production Example A30

Production of Graphitized Particle 30

Graphitized particle 30 was obtained in the same way as in Production Example A29 except that the graphite was so pulverized as to be 17 μm in average particle diameter.

Production Example A31

Production of Graphitized Particle 31

Graphitized particle 31 was obtained in the same way as in Production Example A29 except that the graphite was so pulverized as to be 0.5 μm in average particle diameter.

Production Example A32

Production of Graphitized Particle 32

Graphitized particle 32 was obtained in the same way as in Production Example A4 except that the reaction product was so pulverized as to be about 11 μm in average particle diameter, and conditions for the classification were changed.

About the respective Graphitized particles 1 to 32, their average particle diameter, graphite (002) plane lattice spacing, length/breadth ratio and proportion of particle diameter in the range of from 0.5 A to 5 A (μm) were measured. The results are shown in Table 1.

TABLE 1

| Graphitized particle No. | Average particle diam. A (μm) | Graphite (002) plane lattice spacing (nm) | Raman spectrum half width ($cm^{-1}$) | Ratio of major axis to minor axis | Proportion of particle diameter of from 0.5A μm to 5A μm (%) |
|---|---|---|---|---|---|
| 1 | 3.5 | 0.3375 | 23 | 1.1 | 95 |
| 2 | 1.5 | 0.3390 | 25 | 1.3 | 88 |
| 3 | 6.1 | 0.3440 | 35 | 1.2 | 90 |
| 4 | 4.0 | 0.3420 | 35 | 1.5 | 91 |
| 5 | 3.0 | 0.3365 | 33 | 1.6 | 88 |
| 6 | 4.0 | 0.3400 | 43 | 1.3 | 86 |
| 7 | 2.5 | 0.3444 | 50 | 1.1 | 85 |
| 8 | 6.0 | 0.3361 | 27 | 1.3 | 83 |
| 9 | 7.6 | 0.3385 | 30 | 1.4 | 82 |
| 10 | 2.3 | 0.3430 | 52 | 1.9 | 79 |
| 11 | 6.4 | 0.3372 | 30 | 1.2 | 75 |
| 12 | 9.0 | 0.3430 | 45 | 1.5 | 83 |
| 13 | 10.9 | 0.3380 | 35 | 1.8 | 90 |
| 14 | 10.0 | 0.3400 | 25 | 1.2 | 87 |
| 15 | 13.6 | 0.3445 | 47 | 1.5 | 90 |
| 16 | 7.0 | 0.3445 | 46 | 2.1 | 83 |
| 17 | 1.5 | 0.3448 | 49 | 1.7 | 78 |
| 18 | 5.0 | 0.3420 | 34 | 1.3 | 72 |
| 19 | 3.0 | 0.3400 | 33 | 1.6 | 78 |
| 20 | 7.9 | 0.3390 | 30 | 2.3 | 75 |
| 21 | 1.0 | 0.3364 | 25 | 2.2 | 78 |
| 22 | 11.5 | 0.3370 | 38 | 2.5 | 70 |
| 23 | 0.8 | 0.3400 | 30 | 1.6 | 81 |
| 24 | 0.7 | 0.3430 | 54 | 2.1 | 60 |
| 25 | 14.0 | 0.3370 | 24 | 2.3 | 70 |
| 26 | 0.5 | 0.3361 | 35 | 1.8 | 81 |
| 27 | 15.0 | 0.3440 | 40 | 2.3 | 65 |
| 28 | 10.0 | 0.3460 | 82 | 2.2 | 75 |
| 29 | 10.0 | 0.3356 | 18 | 3.1 | 65 |
| 30 | 17.0 | 0.3355 | 16 | 3.6 | 70 |
| 31 | 0.4 | 0.3355 | 21 | 4.1 | 50 |
| 32 | 11.0 | 0.3410 | 29 | 2.1 | 75 |

B: Production of Elastic Roller

Production Example B1

Production of Elastic Roller 1

A rod made of stainless steel and 6 mm in diameter and 252.5 mm in length was coated with a heat-curable adhesive impregnated with 15% of carbon black, followed by drying. This was used as a conductive substrate. To 100 parts by mass of epichlorohydrin rubber (EO-EP-AGC terpolymer; EO/EP/AGC=73 mol %/23 mol %/4 mol %), the following components were added, and the mixture obtained was kneaded for 10 minutes by means of a closed mixer controlled at 50° C. to prepare a raw-material compound.

| | |
|---|---|
| Calcium carbonate | 60 parts by mass |
| Aliphatic polyester type plasticizer | 10 parts by mass |
| Zinc stearate | 1 part by mass |
| 2-Mercaptobenzimidazole (age resistor) | 0.5 part by mass |
| Zinc oxide | 2 parts by mass |
| Quaternary ammonium salt | 2 parts by mass |
| Carbon black (average particle diameter: 100 nm; volume resistivity: 0.1 Ω · cm) | 5 parts by mass |

To this raw-material compound, 0.8 part by mass of sulfur as a vulcanizing agent, and as vulcanization accelerators 1 part by mass of dibenzothiazyl sulfide (DM) and 0.5 part by mass of tetramethylthiuram monosulfide (TS) were added. Then, these were kneaded for 10 minutes by means of a twin-roll mill kept cooled to 20° C., to obtain an elastic layer forming compound. Together with the above conductive substrate, the elastic layer forming compound was so extruded by means of an extruder with a crosshead as to be made into the shape of a roller of 9 mm in outer diameter, which was then put into an electric oven kept heated at 160° C., and was heated for 1 hour to effect vulcanization and cure the adhesive. The roller obtained was cut across its both-end rubber portions to have a rubber length of 228 mm, and was thereafter so sanded on its surface as to have the shape of a roller of 8.5 mm in outer diameter, thus the elastic layer was formed on the conductive substrate to obtain Elastic Roller 1, having the elastic layer. This roller was in a crown level (difference between outer diameter at the middle and that at the positions each that are 90 mm away from the middle toward the both ends) of 120 μm.

Production Example B2

Production of Elastic Roller 2

Elastic Roller 2 was produced in the same way as in Production Example B1 except that, as the epichlorohydrin rubber, epichlorohydrin rubber (EO-EP-AGC terpolymer; EO/EP/AGC=53 mol %/40 mol %/4 mol %) was used.

Production Example B3

Production of Elastic Roller 3

Elastic Roller 3 was produced in the same way as in Production Example B1 except that, as the epichlorohydrin rubber, epichlorohydrin rubber (EO-EP-AGC terpolymer; EO/EP/AGC=40 mol %/53 mol %/4 mol %) was used.

Production Example B4

Production of Elastic Roller 4

Elastic Roller 4 was produced in the same way as in Production Example B1 except that, as the epichlorohydrin rubber, epichlorohydrin rubber (EO-EP-AGC terpolymer; EO/EP/AGC=35 mol %/61 mol %/4 mol %) was used.

Production Example C1

Production of Composite Conductive Fine Particles C1

To 7.0 kg of silica particles (average particle diameter: 15 nm; volume resistivity: $1.8\times10^{12}$ Ω·cm), 140 g of methylhydrogenpolysiloxane was added operating an edge runner mill, and these materials were mixed and agitated for 30 minutes at a linear load of 588 N/cm (60 kg/cm). Here, the agitation was carried out at a speed of 22 rpm. To what was thus agitated, 7.0 kg of carbon black particles (average particle diameter: 20 nm; volume resistivity: $1.0\times10^{2}$ Ω·cm; pH: 8.0) were added over a period of 10 minutes, operating an edge runner mill, and these materials were further mixed and agitated for 60 minutes at a linear load of 588 N/cm (60 kg/cm). Thus, the carbon black was made to adhere to the surfaces of silica particles coated with methylhydrogenpolysiloxane, followed by drying at 80° C. for 60 minutes by means of a dryer to obtain Composite Conductive Fine Particles C1. Here, the agitation was carried out at a speed of 22 rpm. Composite Conductive Fine Particles C1 had an average particle diameter of 15 nm and a volume resistivity of $1.1\times10^{2}$ Ω·cm.

Production Example C2

Production of Surface-Treated Titanium Oxide Particles C2

1,000 g of rutile type titanium oxide particles (average particle diameter: 15 nm; length/breadth=3:1; volume resistivity: $2.3\times10^{10}$ Ω·cm) was compounded with 110 g of isobutyltrimethoxysilane as a surface treating agent and 3,000 g of toluene as a solvent to prepare a slurry. This slurry was mixed for 30 minutes by means of a stirrer, and thereafter fed to Visco mill the effective internal volume of which was filled by 80%, with glass beads of 0.8 mm in average particle diameter, to carry out wet disintegration at a temperature of 35±5° C. This slurry was distilled under reduced pressure by using a kneader (bath temperature: 110° C.; product temperature: 30 to 60° C.; degree of reduced pressure: about 100 Torr) to remove the toluene, followed by baking of the surface treating agent at 120° C. for 2 hours. The particles having been treated by baking were cooled to room temperature, and thereafter pulverized by means of a pin mill to obtain Surface-treated Titanium Oxide Particles C2.

Example 1

Preparation of Surface Layer Forming Coating Solution

ϵ-Caprolactone modified acrylic polyol solution (trade name: PLACCEL DC2016, available from Daicel Chemical Industries, Ltd.) was readied. This ϵ-caprolactone modified acrylic polyol solution is a solution of 70% of ϵ-caprolactone modified acrylic polyol and 30% of xylylene. The ϵ-caprolactone modified acrylic polyol is represented by the following structural formula (III), and has a number average molecular weight of 4,500, a weight average molecular weight of 9,000 and a hydroxyl value (KOH.mg/g) of 80.

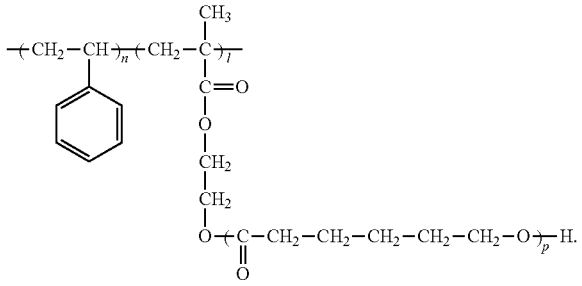

To this solution, methyl isobutyl ketone was added to dilute the former so as to be 19% by mass in solid content. To 526.3 parts by mass of the dilute solution obtained (100 parts by mass of the acrylic polyol solid content), the following components were added to prepare a mixture solution.

| | |
|---|---|
| Composite Conductive Fine Particles C1 | 45 parts by mass |
| Surface-treated Titanium Oxide Particles C2 | 20 parts by mass |
| Modified dimethylsilicone oil (*1) | 0.08 part by mass |
| Blocked isocyanate mixture (*2) | 80.14 parts by mass |

Here, the blocked isocyanate mixture was in an amount given by "NCO/OH=1.0". What was noted above by *1 is dimethylsilicone oil "SH28PA" (trade name: available from Dow Corning Toray Silicone Co., Ltd.). That by *2 is a 7:3 mixture of hexamethylene diisocyanate (HDI) and isophorone diisocyanate (IPDI) each blocked with butanone oxime.

201 g of the above mixture solution was put into a glass bottle of 450 ml in internal volume together with 200 g of glass beads of 0.8 mm in average particle diameter as dispersion media, followed by dispersion for 100 hours using a paint shaker dispersion machine. After the dispersion, 2.85 g of graphitized particles 1 was added (an amount corresponding to 10 parts by mass of the graphitized particles based on 100 parts by mass of the acrylic polyol solid content). The dispersion was further carried out for 5 minutes, and then the glass beads were removed to obtain a surface layer forming coating solution.

Production of Charging Roller

The above surface layer forming coating solution was dip-coated once on the elastic layer produced in Production Example B1. This was air-dried at normal temperature for 30 minutes or more, followed by drying at 80° C. for 1 hour by means of a circulating hot-air dryer, and further drying at 160° C. for 1 hour to form a surface layer on the elastic layer to obtain a charging roller. Regarding the dip coating, dipping time was 9 seconds, and dip coating draw-up rate was so set that the initial rate was 20 mm/second and the final rate was 2 mm/second, in the course of which the rate was changed linearly with respect to time.

Concerning the graphitized particles in the surface layer of the charging roller obtained, their volume average particle diameter, graphite (002) plane lattice spacing, Raman spectrum half width, length/breadth ratio and proportion of particle diameter in the range of from 0.5 A to 5 A μm were measured by the methods described previously. The results are shown in Table 3.

Measurement of Electrical Resistance Value of Charging Roller

Electrical resistance of the charging roller was measured with the instrument shown in FIGS. 2A and 2B. First, with application of a load through the bearings 33*a* and 33*b*, the charging roller was brought into contact with the cylindrical metal 32 (diameter: 30 nm) in such a way that the former was in parallel to the latter (FIG. 2A). Here, the pressure of contact was controlled to be 4.9 N at each end portion, i.e., at 9.8 N at both end portions in total by the pressing force applied by springs. Next, the charging roller was follow-up rotated with the cylindrical metal 32 driven and rotated by means of a motor (not shown) at a peripheral speed of 45 mm/second. While the charging roller was follow-up rotated, a DC voltage of −200 V was applied thereto from the stabilized power source 34 as shown in FIG. 2B, and the value of electric current flowing to the charging roller was measured with the ammeter 35. The electrical resistance of the charging roller was calculated from applied voltage and electric current values.

The charging roller produced was measured for its electric current value after it was left to stand in an N/N (normal temperature and normal humidity: 23° C., 55% RH) environment for 24 hours. This value was taken as electrical resistance at the initial stage. Next, this charging roller was placed in a temperature 40° C. and humidity 95% RH environment for 30 days, and then in the N/N environment for 7 days. The electrical resistance of this charging roller was measured. This value was taken as electrical resistance after the environmental test. The electrical resistance at the initial stage, the electrical resistance after the environmental test and the rate of change in electrical resistance are shown in Table 4. Here, as to the rate of change, the value found when an absolute value of a difference between the electrical resistance at the initial stage and the electrical resistance after the environmental test is divided by the electrical resistance at the initial stage is shown by percent.

Image Evaluation after Leaving in Temperature 40° C. and Humidity 95% RH Environment A color laser printer (trade name: LBP 5400; manufactured by CANON INC.) was used as the electrophotographic apparatus set up as shown in FIG. 3, which was used after it was so converted as to enable output of recorded images at 150 mm/second and 100 mm/second (A4 lengthwise output). The resolution of images was 600 dpi, and the output of primary charging was −1,100 V in DC voltage. A process cartridge for the above printer was used (for black) as the process cartridge set up as shown in FIG. 4. A charging roller of this process cartridge was changed for the charging roller having been left to stand in the 40° C., 95% RH environment for a month. The charging roller was brought into contact with the electrophotographic photosensitive member under a pressure of 4.9 N at each end portion, i.e., at 9.8 N at both end portions in total by the pressing force applied by springs.

This process cartridge was left to stand in a temperature 15° C. and humidity 10% RH environment (environment 1), a temperature 23° C. and humidity 50% RH environment (environment 2) and a temperature 30° C. and humidity 80% RH environment (environment 3) each for 24 hours, and thereafter running evaluation was made in each environment. Stated specifically, a running test was conducted in which E-letter images with a print density of 1% were outputted two-sheet intermittently (running in such a way that the rotation of the printer was stopped every two sheets for 3 seconds) at a process speed of 150 mm/second. Halftone images were also outputted in each environment after image formation on 1,000 sheets, 10,000 sheets and 20,000 sheets each.

The halftone images in this test were such images that horizontal lines each being 1 dot in width and 2 dots in space were drawn in the rotational direction and vertical direction of the electrophotographic photosensitive member. The images were checked by outputting the images at two kinds of process speed, to make evaluation. The images obtained were visually observed to make evaluation on any fine lines and blotches caused by non-uniform charging and according to the following criteria. The results of evaluation are shown in Table 5.

Rank 1: Neither fine lines nor blotches are seen.

Rank 2: Slight fine lines and blotches are seen, but not seen at the cycle of the charging roller.

Rank 3: Fine lines and blotches are seen to have occurred at some part at the cycle of the charging roller, but images are of no problem in practical use.

Rank 4: Fine lines and blotches are conspicuous, and image quality is seen to have lowered.

Example 2

To ϵ-caprolactone modified acrylic polyol solution (trade name: PLACCEL DC2016, available from Daicel Chemical Industries, Ltd.), methyl isobutyl ketone was added to dilute the former so as to be 22% by mass in solid content. To 454.54 parts by mass of the dilute solution obtained (100 parts by mass of the acrylic polyol solid content), the following components were added to prepare a mixture solution.

| | |
|---|---|
| Carbon black "#52" (available from Mitsubishi Chemical Corporation) | 50 parts by mass |
| Modified dimethylsilicone oil (*1) | 0.08 part by mass |
| Blocked isocyanate mixture (*2) | 80.14 parts by mass |

Here, the blocked isocyanate mixture was in an amount given by "NCO/OH=1.0". What were noted above by *1 and *2 are the same as those in Example 1.

Next, 209 g of the above mixture solution was put into a glass bottle of 450 ml in internal volume together with 200 g of glass beads of 0.8 mm in average particle diameter as dispersion media, followed by dispersion for 100 hours using a paint shaker dispersion machine. After the dispersion, 6.6 g of Graphitized particles 1 was added (an amount corresponding to 20 parts by mass of Graphitized particles 1 based on 100 parts by mass of the acrylic polyol solid content). Thereafter, the dispersion was further carried out for 5 minutes, and then the glass beads were removed to obtain a surface layer forming coating solution. A charging roller was produced in the same way as in Example 1 except that this coating solution was used instead. The charging roller according to this Example was evaluated in the same way as in Example 1. The results are shown in Tables 3 to 5.

Example 3

A surface layer forming coating solution was prepared in the same way as in Example 1 except that 2.85 g of polymethyl methacrylate resin particles of 10 μm in average particle diameter were further added. This coating solution contained the graphitized particles and the polymethyl methacrylate resin particles in an amount of 10 parts by mass each, based on 100 parts by mass of the acrylic polyol solid content. A charging roller was produced in the same way as in Example 1 except that this coating solution was used instead. The charging roller according to this Example was evaluated in the same way as in Example 1. The results are shown in Tables 3 to 5.

Example 4

Alcohol modified silicone oil (trade name: FZ-3711; available from Dow Corning Toray Silicone Co., Ltd.) was made into a prepolymer by using a bifunctional isocyanate. An HEMA-containing acrylic resin (glass transition temperature: 27° C.) was dissolved in methyl ethyl ketone, and the above prepolymer was added thereto in an amount of 30 parts by mass based on 100 parts by mass of the acrylic resin. The methyl ethyl ketone was so added that the prepolymer was 19% by mass in solid content to prepare a dilute solution. To 526.3 parts by mass of this solution (100 parts by mass of the acrylic polyol solid content), the following component was added to prepare a mixture solution.

| | |
|---|---|
| Carbon black "#52" (available from Mitsubishi Chemical Corporation) | 40 parts by mass |

196.1 g of the above mixture solution was put into a glass bottle of 450 ml in internal volume together with 200 g of glass beads of 0.8 mm in average particle diameter as dispersion media, followed by dispersion for 60 hours using a paint shaker dispersion machine. After the dispersion, 8.55 g of Graphitized particles 2 and 2.85 g of polymethyl methacrylate resin particles of 8 μm in average particle diameter were further added (amounts corresponding to 30 parts by mass of the graphitized particles and 10 parts by mass of the polymethyl methacrylate resin particles both based on 100 parts by mass of the above solid content). Thereafter, the dispersion was further carried out for 5 minutes, and then the glass beads were removed to obtain a surface layer forming coating solution. A charging roller was produced in the same way as in Example 1 except that this coating solution was used instead. The charging roller according to this Example was evaluated in the same way as in Example 1. The results are shown in Tables 3 to 5.

Examples 5 to 7

Surface layer forming coating solutions were prepared in the same way as in Example 2 except that graphitized particles and the amounts thereof were changed as shown in Table 2. Then, charging rollers were produced in the same way as in Example 1 except that the respective coating solutions were used instead and Elastic Roller 1 was changed for Elastic Roller 2. The charging rollers according to these Examples were evaluated in the same way as in Example 1. The results are shown in Tables 3 to 5.

Example 8

A surface layer forming coating solution was prepared in the same way as in Example 4 except that the graphitized particles and the amounts thereof were changed as shown in Table 2. A charging roller was produced in the same way as in Example 1 except that this coating solution was used instead and Elastic Roller 1 was changed for Elastic Roller 3. The charging roller according to this Example was evaluated in the same way as in Example 1. The results are shown in Tables 3 to 5.

Example 9

A surface layer forming coating solution was prepared in the same way as in Example 1 except that the time for paint shaker dispersion was changed to 48 hours, and the graphitized particles and the amounts thereof were changed as shown in Table 2. A charging roller was produced in the same way as in Example 8 except that this coating solution was used instead. The charging roller according to this Example was evaluated in the same way as in Example 1. The results are shown in Tables 3 to 5.

Example 10

Silicone resin "SR2360" (trade name; available from Dow Corning Toray Silicone Co., Ltd.) was so dissolved in toluene as to be 17% in solid content. To 588.3 parts by mass of this solution (100 parts by mass of the solid content), the following component was added to prepare a mixture solution.

| | |
|---|---|
| Carbon black "#52" (available from Mitsubishi Chemical Corporation) | 40 parts by mass |

191.3 g of the above mixture solution was put into a glass bottle of 450 ml in internal volume together with 200 g of glass beads of 0.8 mm in average particle diameter as dispersion media, followed by dispersion for 24 hours using a paint shaker dispersion machine. After the dispersion, 1.275 g of graphitized particles 7 and 1.275 g of polymethyl methacrylate resin particles of 10 μm in average particle diameter were further added (amounts corresponding to 5 parts by mass of the graphitized particles and 5 parts by mass of the polymethyl methacrylate resin particles both based on 100 parts by mass of the above solid content). Thereafter, the dispersion was further carried out for 5 minutes, and then the glass beads were removed to obtain a surface layer forming coating solution. A charging roller was produced in the same way as in Example 8 except that this coating solution was used instead. The charging roller according to this Example was evaluated in the same way as in Example 1. The results are shown in Tables 3 to 5.

Example 11

A surface layer forming coating solution was prepared in the same way as in Example 4 except that the graphitized particles and the amounts thereof were changed as shown in Table 2. A charging roller was produced in the same way as in Example 1 except that this coating solution was used instead and Elastic Roller 1 was changed for Elastic Roller 4. The charging roller according to this Example was evaluated in the same way as in Example 1. The results are shown in Tables 3 to 5.

Example 12

A surface layer forming coating solution was prepared in the same way as in Example 4 except that the time for paint shaker dispersion was changed to 24 hours, and the graphitized particles and the amounts thereof were changed as shown in Table 2. A charging roller was produced in the same way as in Example 11 except that this coating solution was used instead. The charging roller according to this Example was evaluated in the same way as in Example 1. The results are shown in Tables 3 to 5.

Examples 13 to 16

Surface layer forming coating solutions were prepared in the same way as in Example 2 except that graphitized particles and the amounts thereof were changed as shown in Table 2. Charging rollers were produced in the same way as in Example 1 except that these coating solutions were used instead. The charging rollers according to these Examples were evaluated in the same way as in Example 1. The results are shown in Tables 3 to 5.

Examples 17 to 20

Surface layer forming coating solutions were prepared in the same way as in Example 10 except that the time for paint shaker dispersion was changed to 48 hours, and the graphitized particles and the amounts thereof were changed as shown in Table 2. Charging rollers were produced in the same way as in Example 1 except that these coating solutions were used instead. The charging rollers according to these Examples were evaluated in the same way as in Example 1. The results are shown in Tables 3 to 5.

Example 21

Surface layer forming coating solutions were prepared in the same way as in Example 4 except that the graphitized particles and the amounts thereof were changed as shown in Table 2, and the polymethyl methacrylate resin particles were not added. Charging rollers were produced in the same way as in Example 8 except that these coating solutions were used instead. The charging rollers according to these Examples were evaluated in the same way as in Example 1. The results are shown in Tables 3 to 5.

Examples 22 to 25

Surface layer forming coating solutions were prepared in the same way as in Example 1 except that the graphitized particles and the amounts thereof were changed as shown in Table 2. Charging rollers were produced in the same way as in Example 1 except that these coating solutions were used instead. The charging rollers according to these Examples were evaluated in the same way as in Example 1. The results are shown in Tables 3 to 5.

Example 26

A surface layer forming coating solution was prepared in the same way as in Example 1 except that the graphitized particles and the amounts thereof were changed as shown in Table 2. A charging roller was produced in the same way as in Example 8 except that this coating solution was used instead. The charging roller according to this Example was evaluated in the same way as in Example 1. The results are shown in Tables 3 to 5.

Example 27

A surface layer forming coating solution was prepared in the same way as in Example 10 except that the time for paint shaker dispersion was changed to 48 hours, and the graphitized particles and the amounts thereof were changed as shown in Table 2. A charging roller was produced in the same way as in Example 11 except that this coating solution was used instead. The charging roller according to this Example was evaluated in the same way as in Example 1. The results are shown in Tables 3 to 5.

Example 28

A surface layer forming coating solution was prepared in the same way as in Example 17 except that the graphitized particles and the amounts thereof were changed as shown in Table 2. A charging roller was produced in the same way as in Example 1 except that this coating solution was used instead. The charging roller according to this Example was evaluated in the same way as in Example 1. The results are shown in Tables 3 to 5.

Example 29

A surface layer forming coating solution was prepared in the same way as in Example 17 except that the graphitized particles and the amounts thereof were changed as shown in Table 2. A charging roller was produced in the same way as in Example 1 except that this coating solution was used instead. The charging roller according to this Example was evaluated in the same way as in Example 1. The results are shown in Tables 3 to 5.

Comparative Example 1

A charging roller was obtained in the same way as in Example 13 except that the graphitized particles were not added. The charging roller according to this Comparative Example was evaluated in the same way as in Example 1. The results are shown in Tables 3 to 5.

Comparative Examples 2 and 3

Charging rollers were obtained in the same way as in Example 2 except that the types and amounts of the graphitized particles added were changed as shown in Table 2. The charging rollers according to these Comparative Examples were evaluated in the same way as in Example 1. The results are shown in Tables 3 to 5.

Comparative Example 4

A surface layer forming coating solution was prepared in the same way as in Comparative Example 2 except that the type and amount of the graphitized particles added were changed as shown in Table 2. A charging roller was obtained in the same way as in Comparative Example 2 except that this coating solution was used instead and also Elastic Roller 1 was changed for Elastic Roller 3. The charging roller according to this Comparative Example was evaluated in the same way as in Example 1. The results are shown in Tables 3 to 5.

Comparative Example 5

A surface layer forming coating solution was prepared in the same way as in Example 17 except that the type and amount of the graphitized particles added were changed as shown in Table 2. A charging roller was obtained in the same way as in Example 17 except that this coating solution was used instead and also Elastic Roller 3 used instead. The charging roller according to this Comparative Example was evaluated in the same way as in Example 1. The results are shown in Tables 3 to 5.

Comparative Example 6

Preparation of Surface Layer Coating Solution

To 500 parts by mass of a solution prepared by so dissolving polyvinyl butyral with ethanol as to be 20% by mass in solid content (100 parts by mass of polyvinyl butyral solid content), 20 parts by mass of carbon black "MA100" (trade name; available from Mitsubishi Chemical Corporation) was added to prepare a mixture solution. Then, 185.6 g of this mixture solution was put into a glass bottle of 450 ml in internal volume together with 200 g of glass beads of 0.8 mm in average particle diameter as dispersion media, followed by dispersion for 12 hours using a paint shaker dispersion machine. Thereafter, 3.0 g of Graphitized particles 32 was further added. Incidentally, this is an amount corresponding to 10 parts by mass based on 100 parts by mass of the polyvinyl butyral solid content. Thereafter, the dispersion was further carried out for 24 hours, and thereafter the glass beads were removed to obtain a surface layer forming coating solution. A charging roller was produced in the same way as in Example 1 except that this surface layer coating solution was used instead. The charging roller according to this Comparative Example was evaluated in the same way as in Example 1. The results are shown in Tables 3 to 5.

TABLE 2

| | Graphitized particle No. | Part(s) by mass |
|---|---|---|
| Example | | |
| 1 | Graphitized particle 1 | 10 |
| 2 | Graphitized particle 1 | 20 |
| 3 | Graphitized particle 1 | 10 |
| 4 | Graphitized particle 2 | 30 |
| 5 | Graphitized particle 3 | 5 |
| 6 | Graphitized particle 4 | 20 |
| 7 | Graphitized particle 16 | 10 |
| 8 | Graphitized particle 5 | 30 |
| 9 | Graphitized particle 6 | 10 |
| 10 | Graphitized particle 7 | 5 |
| 11 | Graphitized particle 8 | 2 |
| 12 | Graphitized particle 9 | 10 |
| 13 | Graphitized particle 10 | 10 |
| 14 | Graphitized particle 14 | 2 |
| 15 | Graphitized particle 25 | 10 |
| 16 | Graphitized particle 26 | 30 |
| 17 | Graphitized particle 11 | 5 |
| 18 | Graphitized particle 18 | 20 |
| 19 | Graphitized particle 19 | 3 |
| 20 | Graphitized particle 24 | 10 |
| 21 | Graphitized particle 12 | 10 |
| 22 | Graphitized particle 13 | 1 |
| 23 | Graphitized particle 17 | 10 |
| 24 | Graphitized particle 20 | 20 |
| 25 | Graphitized particle 15 | 10 |
| 26 | Graphitized particle 21 | 50 |
| 27 | Graphitized particle 22 | 20 |
| 28 | Graphitized particle 23 | 10 |
| 29 | Graphitized particle 27 | 10 |
| Comparative Example | | |
| 1 | — | — |
| 2 | Graphitized particle 28 | 10 |
| 3 | Graphitized particle 29 | 10 |
| 4 | Graphitized particle 30 | 10 |
| 5 | Graphitized particle 31 | 20 |
| 6 | Graphitized particle 32 | 10 |

TABLE 3

| | Average particle diam. A (μm) | Graphite (002) plane lattice spacing (nm) | Raman spectrum half width ($cm^{-1}$) | Ratio of major axis to minor axis | Proportion of particle diameter of from 0.5A μm to 5A μm (%) |
|---|---|---|---|---|---|
| Example: | | | | | |
| 1 | 3.4 | 0.3374 | 25 | 1.1 | 94 |
| 2 | 3.7 | 0.3375 | 26 | 1.1 | 95 |
| 3 | 3.6 | 0.3374 | 28 | 1.2 | 94 |
| 4 | 1.4 | 0.3390 | 28 | 1.3 | 89 |
| 5 | 6.2 | 0.3440 | 38 | 1.3 | 91 |
| 6 | 4.3 | 0.3423 | 34 | 1.5 | 90 |
| 7 | 7.3 | 0.3445 | 45 | 2.1 | 80 |
| 8 | 3.2 | 0.3365 | 32 | 1.6 | 89 |
| 9 | 4.8 | 0.3401 | 44 | 1.3 | 85 |
| 10 | 2.6 | 0.3444 | 51 | 1.2 | 85 |
| 11 | 6.0 | 0.3362 | 29 | 1.1 | 84 |
| 12 | 7.5 | 0.3385 | 32 | 1.4 | 82 |
| 13 | 2.5 | 0.3433 | 53 | 1.9 | 79 |
| 14 | 10.0 | 0.3400 | 26 | 1.3 | 85 |
| 15 | 13.8 | 0.3371 | 25 | 2.3 | 69 |
| 16 | 0.1 | 0.3362 | 36 | 1.8 | 81 |
| 17 | 6.8 | 0.3371 | 31 | 1.3 | 76 |
| 18 | 5.1 | 0.3421 | 36 | 1.3 | 71 |
| 19 | 3.2 | 0.3401 | 34 | 1.6 | 77 |
| 20 | 0.8 | 0.3431 | 55 | 2.1 | 60 |
| 21 | 9.1 | 0.3432 | 46 | 1.5 | 82 |
| 22 | 10.9 | 0.3379 | 36 | 1.8 | 91 |
| 23 | 1.6 | 0.3449 | 50 | 1.6 | 79 |
| 24 | 7.8 | 0.3391 | 31 | 2.3 | 75 |
| 25 | 13.6 | 0.3445 | 48 | 1.5 | 89 |
| 26 | 1.0 | 0.3362 | 26 | 2.1 | 78 |
| 27 | 11.5 | 0.3371 | 40 | 2.5 | 71 |
| 28 | 0.8 | 0.3410 | 31 | 1.6 | 80 |
| 29 | 14.9 | 0.3441 | 41 | 2.4 | 65 |
| Comparative Example: | | | | | |
| 1 | — | — | — | — | — |
| 2 | 10.3 | 0.3464 | 83 | 2.2 | 72 |
| 3 | 10.2 | 0.3355 | 18 | 3.2 | 64 |
| 4 | 16.5 | 0.3355 | 17 | 3.6 | 70 |
| 5 | 0.4 | 0.3356 | 20 | 4.3 | 51 |
| 6 | 9.0 | 0.3420 | 35 | 2.2 | 40 |

TABLE 4

| | Electrical resistance at initial stage (Ω) | Electrical resistance after environmental test (Ω) | Rate of change in electrical resistance (%) |
|---|---|---|---|
| Example: | | | |
| 1 | 2.50E+04 | 2.53E+04 | 1.2% |
| 2 | 1.00E+04 | 1.01E+04 | 1.0% |
| 3 | 2.00E+04 | 2.05E+04 | 2.5% |
| 4 | 5.00E+03 | 5.10E+03 | 2.0% |
| 5 | 5.00E+04 | 5.02E+04 | 0.4% |
| 6 | 3.00E+04 | 3.03E+04 | 1.0% |
| 7 | 4.00E+04 | 5.00E+04 | 25.0% |
| 8 | 7.00E+03 | 8.00E+03 | 14.3% |
| 9 | 9.00E+03 | 1.00E+04 | 11.1% |
| 10 | 4.00E+04 | 4.50E+04 | 12.5% |
| 11 | 3.20E+04 | 3.50E+04 | 9.4% |
| 12 | 3.20E+04 | 3.60E+04 | 12.5% |
| 13 | 5.60E+04 | 6.50E+04 | 16.1% |
| 14 | 5.00E+03 | 6.00E+03 | 20.0% |
| 15 | 6.00E+04 | 7.50E+04 | 25.0% |
| 16 | 1.00E+04 | 1.20E+04 | 20.0% |
| 17 | 5.70E+04 | 6.10E+04 | 7.0% |
| 18 | 1.00E+04 | 1.20E+04 | 20.0% |
| 19 | 3.00E+04 | 4.00E+04 | 33.3% |
| 20 | 1.00E+03 | 1.32E+03 | 32.0% |
| 21 | 5.00E+04 | 6.50E+04 | 30.0% |

TABLE 4-continued

| | Electrical resistance at initial stage (Ω) | Electrical resistance after environmental test (Ω) | Rate of change in electrical resistance (%) |
|---|---|---|---|
| 22 | 6.00E+04 | 8.00E+04 | 33.3% |
| 23 | 7.00E+04 | 8.00E+04 | 14.3% |
| 24 | 6.30E+04 | 7.50E+04 | 19.0% |
| 25 | 8.00E+03 | 9.00E+03 | 12.5% |
| 26 | 6.40E+04 | 8.50E+04 | 32.8% |
| 27 | 8.00E+03 | 1.00E+04 | 25.0% |
| 28 | 1.00E+04 | 1.34E+04 | 34.0% |
| 29 | 6.03E+03 | 6.89E+03 | 14.2% |
| Comparative Example: | | | |
| 1 | 4.00E+04 | 6.00E+04 | 50.0% |
| 2 | 1.00E+04 | 1.53E+04 | 53.0% |
| 3 | 6.00E+03 | 9.00E+03 | 50.0% |
| 4 | 6.70E+03 | 1.00E+04 | 49.3% |
| 5 | 4.00E+04 | 6.00E+04 | 50.0% |
| 6 | 1.90E+04 | 3.20E+04 | 68.4% |

TABLE 5

| | 15° C., 10% Environment | | | 23° C., 50% Environment | | | 30° C., 80% Environment | | |
|---|---|---|---|---|---|---|---|---|---|
| | 1 k shs. | 10 k shs. | 20 k shs. | 1 k shs. | 10 k shs. | 20 k shs. | 1 k shs. | 10 k shs. | 20 k shs. |
| Example: | | | | | | | | | |
| 1 | 1 | 1 | 1 | 1 | 1 | 1 | 1 | 1 | 1 |
| 2 | 1 | 1 | 1 | 1 | 1 | 1 | 1 | 1 | 1 |
| 3 | 1 | 1 | 1 | 1 | 1 | 1 | 1 | 1 | 1 |
| 4 | 1 | 2 | 2 | 1 | 1 | 2 | 1 | 1 | 1 |
| 5 | 1 | 1 | 2 | 1 | 1 | 2 | 1 | 1 | 1 |
| 6 | 1 | 1 | 2 | 1 | 1 | 1 | 1 | 1 | 1 |
| 7 | 1 | 2 | 2 | 1 | 2 | 2 | 1 | 2 | 2 |
| 8 | 1 | 1 | 1 | 1 | 1 | 1 | 1 | 1 | 1 |
| 9 | 1 | 1 | 1 | 1 | 1 | 1 | 1 | 1 | 1 |
| 10 | 1 | 1 | 2 | 1 | 1 | 2 | 1 | 1 | 2 |
| 11 | 1 | 1 | 1 | 1 | 1 | 1 | 1 | 1 | 2 |
| 12 | 1 | 1 | 2 | 1 | 1 | 2 | 1 | 1 | 2 |
| 13 | 1 | 2 | 3 | 1 | 2 | 2 | 1 | 2 | 2 |
| 14 | 1 | 2 | 3 | 1 | 2 | 2 | 1 | 2 | 2 |
| 15 | 2 | 2 | 3 | 2 | 2 | 3 | 2 | 2 | 3 |
| 16 | 2 | 3 | 3 | 2 | 3 | 3 | 2 | 3 | 3 |
| 17 | 1 | 2 | 3 | 1 | 2 | 2 | 1 | 2 | 3 |
| 18 | 1 | 1 | 3 | 1 | 1 | 2 | 1 | 2 | 3 |
| 19 | 1 | 2 | 3 | 1 | 2 | 2 | 1 | 2 | 3 |
| 20 | 2 | 3 | 3 | 2 | 3 | 3 | 2 | 3 | 3 |
| 21 | 1 | 2 | 3 | 1 | 2 | 2 | 1 | 2 | 2 |
| 22 | 1 | 2 | 3 | 1 | 2 | 3 | 1 | 2 | 3 |
| 23 | 1 | 2 | 3 | 1 | 2 | 2 | 1 | 2 | 3 |
| 24 | 1 | 1 | 3 | 1 | 1 | 2 | 1 | 1 | 3 |
| 25 | 1 | 2 | 2 | 1 | 2 | 2 | 1 | 2 | 2 |
| 26 | 1 | 2 | 3 | 1 | 2 | 3 | 1 | 2 | 3 |
| 27 | 1 | 2 | 2 | 1 | 2 | 2 | 1 | 3 | 3 |
| 28 | 2 | 3 | 3 | 2 | 3 | 3 | 2 | 3 | 3 |
| 29 | 2 | 3 | 3 | 2 | 2 | 3 | 2 | 3 | 3 |
| Comparative Example: | | | | | | | | | |
| 1 | 3 | 4 | 4 | 3 | 4 | 4 | 3 | 4 | 4 |
| 2 | 2 | 3 | 4 | 2 | 3 | 4 | 2 | 3 | 4 |
| 3 | 3 | 3 | 4 | 3 | 3 | 4 | 2 | 3 | 4 |
| 4 | 3 | 4 | 4 | 2 | 3 | 4 | 3 | 3 | 4 |
| 5 | 3 | 4 | 4 | 2 | 4 | 4 | 3 | 4 | 4 |
| 6 | 3 | 3 | 4 | 3 | 3 | 4 | 4 | 4 | 4 |

k: 1,000;
shs.: sheets

The above embodiments are all only those showing examples of embodiment in practicing the present invention, and shall not be those by which the technical scope of the present invention is construed as being restrictive. That is, the present invention may be practiced in various forms without deviation from its technical idea or its main features.

This application claims the benefit of Japanese Patent Application No. 2008-275702, filed Oct. 27, 2008, which is hereby incorporated by reference in its entirety.

What is claimed is:

1. A charging member comprising an electroconductive substrate, an electroconductive elastic layer formed thereon, and an electroconductive surface layer, wherein said elastic layer comprises a polymer having a unit derived from ethylene oxide, wherein said surface layer comprises a binder resin and graphitized particles dispersed in said binder resin, wherein said binder resin comprises a resin having a urethane linkage in its molecule, wherein said graphitized particles have (i) a graphite (002) plane lattice spacing of from 0.3362 nm or more to 0.3449 nm or less and (ii) an average particle diameter of 1 μm to 8 μm, wherein said resin having in its molecule a urethane linkage is a graft polymer having said urethane linkage in a side chain thereof, wherein said urethane linkage in said side chain is intercalated into a graphitized particle of said graphitized particles, wherein said resin has a backbone chain formed of an acrylic resin or a styrene resin, a part where said backbone chain is linked with said side chain is an ester linkage, and an alkylene group having 2 or more carbon atoms is made present between said ester linkage and said urethane linkage in said side chain.

2. The charging member according to claim 1, wherein said resin is a reactant of (i) a polyol having a backbone chain formed of an acrylic resin or styrene resin, and having a hydroxyl group on a side chain thereof, and (ii) a compound having an isocyanate group.

3. A process cartridge comprising:

the charging member according to claim 1; and an electrophotographic photosensitive member, wherein the process cartridge is constituted so as to be detachably mountable to a main body of an electrophotographic apparatus.

4. An electrophotographic apparatus comprises:

the charging member according to claim 1; and an electrophotographic photosensitive member to be electrostatically charged by means of the charging member.

5. The electrophotographic apparatus according to claim 4, wherein only a direct-current voltage is applied to the charging member to electrostatically charge said electrophotographic photosensitive member.

* * * * *